US008953823B2

(12) United States Patent
Fujise et al.

(10) Patent No.: US 8,953,823 B2
(45) Date of Patent: Feb. 10, 2015

(54) PIEZOELECTRIC SPEAKER AND PIEZOELECTRIC SPEAKER ARRAY

(75) Inventors: Akiko Fujise, Osaka (JP); Toshiyuki Matsumura, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 600 days.

(21) Appl. No.: 13/308,893

(22) Filed: Dec. 1, 2011

(65) Prior Publication Data

US 2012/0140969 A1 Jun. 7, 2012

(30) Foreign Application Priority Data

Dec. 2, 2010 (JP) ..... 2010-269680

(51) Int. Cl.
*H04R 25/00* (2006.01)
*H04R 1/24* (2006.01)
*H04R 17/00* (2006.01)

(52) U.S. Cl.
CPC ..... *H04R 1/24* (2013.01); *H04R 17/00* (2013.01); *H04R 2430/03* (2013.01); *H04R 2499/11* (2013.01); *H04R 2499/15* (2013.01)
USPC ..... 381/190

(58) Field of Classification Search
CPC ..... H04R 17/00; H04R 17/005; H04R 17/10; H04R 2499/15
USPC ..... 381/114, 173, 190
See application file for complete search history.

(56) References Cited

U.S. PATENT DOCUMENTS

2011/0128245 A1* 6/2011 Andoh et al. ..... 345/173

FOREIGN PATENT DOCUMENTS

JP 9-327094 12/1997

OTHER PUBLICATIONS

Hye Jin Kim et al., "High Performance Piezoelectric Microspeakers and Thin Speaker Array System", ETRI Journal, vol. 31, No. 6, Dec. 2009, pp. 680-687.

* cited by examiner

*Primary Examiner* — Matthew Eason
(74) *Attorney, Agent, or Firm* — Wenderoth, Lind & Ponack, L.L.P.

(57) ABSTRACT

A piezoelectric speaker is a piezoelectric speaker which radiates acoustic waves by vibrating according to an applied voltage, including (i) a substrate which includes a first region having first bending stiffness against bending of a plane perpendicular to a vibration direction and a second region having second bending stiffness against bending of the perpendicular plane, the second bending stiffness being different from the first bending stiffness, (ii) a first piezoelectric element which is mounted on the first region and to which a voltage of a first frequency band is applied, and (iii) a second piezoelectric element which is mounted on the second region and to which a voltage of a second frequency band different from the first frequency band is applied.

22 Claims, 13 Drawing Sheets

$f_{LL}$ : Lower end of output frequency band of low frequency band pass unit $f_{LH}$ : Upper end of output frequency band of low frequency band pass unit $f_{HL}$ : Lower end of output frequency band of high frequency band pass unit $f_{HH}$ : Upper end of output frequency band of high frequency band pass unit

PIEZOELECTRIC SPEAKER AND PIEZOELECTRIC SPEAKER ARRAY

CROSS REFERENCE TO RELATED APPLICATION

The present application is based on and claims priority of Japanese Patent Application No. 2010-269680 filed on Dec. 2, 2010. The entire disclosure of the above-identified application, including the specification, drawings and claims is incorporated herein by reference in its entirety.

BACKGROUND OF THE INVENTION (1) Field of the Invention

The present invention relates to piezoelectric speakers which radiate acoustic waves by vibrating according to an applied voltage.

(2) Description of the Related Art

Conventionally, speaker arrays, in which many small speakers are arranged, are available. Such speaker arrays control directivity of acoustic waves and realize sound sources that make it possible for users to simultaneously listen to the most appropriate sound (acoustics) at plural listening positions. An electrodynamic method has been mainly used as a method to drive a speaker included in a speaker array.

Recently, in view of the background of miniaturization of audio-visual apparatuses and information equipment, a speaker array has been proposed based on a piezoelectric method to make a speaker array thinner and lighter than a speaker array based on the electrodynamic method. In Non-Patent Reference 1 (High Performance Piezoelectric Mircospeakers and Thin Speaker Array System, ETRI Journal, Vol. 31, No. 6, December 2009), plural piezoelectric microspeakers (piezoelectric speakers) are arranged. With this, the speaker array strikes a balance between being thinner and controlling desired directivity.

Moreover, separately from the above-mentioned background, there is a piezoelectric speaker described in Patent Reference 1 (Japanese Unexamined Patent Application Publication No. 9-327094) as a speaker which combines miniaturization of the piezoelectric speaker itself with planarization of frequency characteristics. In this piezoelectric speaker, plural electrode regions are provided on a diaphragm formed by a piezoelectric material and an area of vibration varies at every frequency band by a circuit network including inductors.

FIG. 15 is a diagram showing the piezoelectric speaker according to Patent Reference 1. A piezoelectric speaker 910 illustrated in FIG. 15 includes a plate-like diaphragm 912 formed by a piezoelectric material.

On the diaphragm 912, an electrode 916 and five electrode portions 914*a* to 914*e* are formed. By a circuit network 918, a signal is inputted between the electrode 916 and the five electrode portions 914*a* to 914*e*. At this time, via an inductor 922 of the circuit network 918, a signal is inputted to the two electrode portions 914*a* and 914*e*. Moreover, via an inductor 920 of the circuit 918, a signal is inputted to the two electrode portions 914*b* and 914*d*. A signal is directly inputted to the electrode portion 914*c* without relying on these inductors 920 and 922.

Usually, as a frequency becomes higher, impedance of a piezoelectric speaker becomes smaller. Meanwhile, in the piezoelectric speaker 910 described in Patent Reference 1, the impedance of inductors 920 and 922 becomes larger as the signal frequency becomes higher. Therefore, as the signal frequency becomes higher, an area of vibration becomes smaller. With this, a variation in sound pressure caused by a variation in frequency can be reduced.

SUMMARY OF THE INVENTION

However, the speaker array according to Non-Patent Reference 1 is required to narrow an arrangement interval of piezoelectric speakers so as to control directivity. Therefore, the miniaturization of the piezoelectric speaker is necessary. Meanwhile, the miniaturization of the piezoelectric speaker leads to a decrease in reproduction capacity in a bass-range sound.

In other words, it is necessary for the speaker array to arrange many speakers at a narrow interval such that sound quality is secured at plural listening positions. To achieve that goal, each of the speakers needs to be miniaturized. However, as a speaker becomes smaller, reproduction of a bass-range sound becomes more difficult. Especially, this problem becomes more noticeable in a piezoelectric method than in an electrodynamic method.

For example, generally, a low-pitched sound reproduction limit is around 1 to 2 kHz for a piezoelectric speaker, which is contained as a speaker array in an audio-visual (AV) apparatus, having a realistic size. Meanwhile, human voice or a sound signal of AV content has many frequency components from 100 to 1,000 Hz. Therefore, a lack, in reproduced sound, of the components of this frequency band causes significant deterioration in sound quality.

Here, the two following problems emerge in the case where the piezoelectric speaker 910 according to Patent Reference 1 is used in such an AV apparatus.

First, in the diaphragm 912 using a planar plate, a low-pitched sound reproduction limit is determined by a resonance frequency of the whole of the diaphragm 912. The piezoelectric speaker 910 in Patent Reference 1 adjusts, by plural electrode regions, a frequency balance between a bass-range sound and a treble-range sound. However, the piezoelectric speaker 910 is unable to improve the low-pitched sound reproduction limit determined by the resonance frequency of the whole of the diaphragm 912.

Second, in the piezoelectric speaker 910 of Patent Reference 1, the diaphragm 912 is common to plural electrode regions. Therefore, bending vibration, generated in a region to which a signal in a treble-range sound is applied, is transmitted to also a region to which a signal in the high-pitched sound region is not applied. Therefore, deterioration in sound quality by divided vibration of the diaphragm 912 still occurs. Moreover, there is a case where plural treble-range sound signals are applied to plural piezoelectric speakers so as to control directivity. Also in this case, the deterioration in sound quality causes signals to interfere with each other, resulting in deterioration in control characteristics of directivity.

In other words, it is difficult for the piezoelectric speaker 910 in Patent Reference 1 to handle sound in a wide range because there is only one unit of the diaphragm 912. Meanwhile, an establishment of diaphragms in a piezoelectric speaker is detrimental to miniaturization of the piezoelectric speaker.

Therefore, the present invention has an object to provide a piezoelectric speaker which can reduce deterioration in sound quality and secure a capacity of reproducing sound in a wide range even in a limited space.

In order to solve the above mentioned problem, a piezoelectric speaker according to the present invention is a piezoelectric speaker which radiates acoustic waves by vibrating according to an applied voltage, including (i) a substrate which includes a first region having first bending stiffness against bending of a plane perpendicular to a vibration direction and a second region having second bending stiffness against bending of the perpendicular plane, the second bending stiffness being different from the first bending stiffness, (ii) a first piezoelectric element which is mounted on the first region and to which a voltage of a first frequency band is applied, and (iii) a second piezoelectric element which is mounted on the second region and to which a voltage of a second frequency band different from the first frequency band is applied.

With this, bending vibration is generated in each of the two regions corresponding to two bending stiffnesses different with each other. The difference between the two bending stiffnesses makes it difficult to transmit bending vibration generated in one of the regions to the other region. Moreover, these two regions are included in one substrate. Therefore, the piezoelectric speaker can reduce deterioration in sound quality even in a limited space and secure a capacity of reproducing sound in a wide range.

Moreover, the substrate may include the second region having the second bending stiffness against bending of the perpendicular plane, the second bending stiffness being greater than the first bending stiffness, and the voltage of the second frequency band may be applied to the second piezoelectric element, the voltage of the second frequency band being higher than the voltage of the first frequency band.

With this, a region having large bending stiffness can be used as the treble-range sound reproduction region and a region having small bending stiffness can be used as the bass-range sound reproduction region. A fundamental resonance frequency in the region having large bending stiffness is high, while a fundamental resonance frequency in the region having small bending stiffness is low. Therefore, two regions having different bending stiffnesses are appropriately used as the treble-range sound reproduction region and the bass-range sound reproduction region.

Moreover, the substrate may include the first region and the second region, and an area of the second region in the perpendicular plane is smaller than an area of the first region in the perpendicular plane.

With this, a small region can be used as the treble-range sound reproduction region and a large region can be used as the bass-range sound reproduction region. A fundamental resonance frequency is high in the small region, while a fundamental resonance frequency is low in the large region. Therefore, two regions having different sizes are appropriately used as the treble-range sound reproduction region and the bass-range sound reproduction region.

Moreover, the piezoelectric speaker may include a plurality of second piezoelectric elements, each of which is the second piezoelectric element, the substrate may include a plurality of second regions, each of which is the second region and having one of the piezoelectric elements mounted thereon, and the voltage of the second frequency band may be applied to each of the second piezoelectric elements.

With this, size of treble-range sound reproduction regions can be secured as a whole, even in the case where each of the plural treble-range sound reproduction regions is small. Therefore, sound pressure in a treble-range sound is secured. Moreover, it is preferable that sound sources be placed at a narrower interval especially in a treble-range sound so as to control directivity. Therefore, the piezoelectric speaker having the treble-range sound reproduction regions is effective in a piezoelectric speaker array which controls directivity.

Moreover, the substrate, the first piezoelectric element, and the second piezoelectric element may be composed such that a ratio of bending stiffness to a mass per unit length in the first region and the first piezoelectric element is smaller and a ratio of bending stiffness to a mass per unit length in the second region and the second piezoelectric element is larger than a standard ratio specified by a predetermined resonance frequency.

With this, two regions satisfying a standard specified according to a predetermined condition can be appropriately used as a treble-range sound reproduction region and a bass-range sound reproduction region.

Moreover, the piezoelectric speaker may have a circuit which applies the voltage of the first frequency band to the first piezoelectric element and the voltage of the second frequency band to the second piezoelectric element.

With this, an appropriate voltage can be applied to two piezoelectric elements mounted on two regions having bending stiffnesses different with each other.

Moreover, the substrate may be made of a plurality of laminated plate materials, and a thickness of the substrate in the first region is different from a thickness of the substrate in the second region.

With this, a variation in bending stiffnesses can be realized at a low cost. For example, plural plate materials may be made of the same material. Even in such a case, a thickness of a substrate varies according to a form of lamination. Then the variation in bending stiffness can be realized at a low cost by the variation in a thickness of a substrate.

Moreover, the piezoelectric speaker may include a circuit which applies the voltage of the first frequency band to the first piezoelectric element and the voltage of the second frequency band to the second piezoelectric element, and part of the circuit may be placed between the laminated plate materials.

With this, a circuit can be incorporated into a substrate made of plural plate materials. Therefore, the substrate and the circuit are integrated and incorporation into an apparatus becomes easier. Moreover, connection to a circuit at an edge of the substrate becomes possible. Therefore, wiring becomes easier. Moreover, each of the laminated plate materials may be made of polyethylene terephthalate, polycarbonate, or polyimide.

With this, the plural plate materials can be made of materials suited for each of the applications. Polyethylene terephthalate (PET) and polycarbonate are effective in applications requiring lightweight properties and low cost properties. Polyimide is effective in applications requiring properties of resistance to environment such as under high temperature.

Moreover, the substrate may include an edge region having elasticity between the first region and the second region.

This makes it difficult for bending vibration generated in one of the regions to be transmitted to the other region. Therefore, the piezoelectric speaker can reduce deterioration in sound quality.

Moreover, the substrate may include an edge region having elasticity at least in part of a peripheral portion of the first region or the second region.

This makes it difficult for bending vibration generated in a specific region to be transmitted to an outer portion of the region. Therefore, the piezoelectric speaker can reduce deterioration in sound quality.

Moreover, the edge region may be made of polyethersulfone or styrene butadiene rubber.

With this, the edge region can be made of materials suited for each of the applications. Polyethersulfone (PES) is effective in applications requiring heat resistant properties and water resistant properties. Styrene butadiene rubber is effective in applications requiring flat output characteristics.

A piezoelectric speaker array according to the present invention may be a piezoelectric speaker array which includes a plurality of piezoelectric speakers, each of which is the piezoelectric speaker.

With this, the piezoelectric speaker array can control directivity of acoustic waves with use of piezoelectric speakers.

The piezoelectric speaker array according to the present invention may be a piezoelectric speaker array which includes a plurality of piezoelectric speakers, each of which is the piezoelectric speaker, and the plural piezoelectric speakers are arranged such that an interval between the second regions of the piezoelectric speakers is shorter than an interval between the first regions of the piezoelectric speakers.

This allows treble-range sound reproduction regions to be arranged at a relatively narrow interval. Moreover, it is preferable that sound sources be placed at a narrower interval especially in a treble-range sound so as to control directivity. Therefore, the arrangement of treble-range sound reproduction regions at a narrow interval leads to an improvement in performance of directivity control.

Moreover, the plural piezoelectric speakers may be arranged at a predetermined interval.

With this, turbulence of acoustic waves radiated from the piezoelectric speaker array can be controlled, leading to an improvement in the performance of directivity control. In other words, the desired directivity can be obtained without using a complicated control.

Moreover, the plural piezoelectric speakers may be arranged on one of a straight line, a convex curved line, a concave curved line, a planar surface, a convex surface, and a concave surface.

With this, turbulence of acoustic waves radiated from the piezoelectric speaker array can be controlled, thus leading to an improvement in performance of directivity. In other words, the desired directivity can be obtained without using a complicated control.

Moreover, the plural piezoelectric speakers may be arranged to form rows and columns along two axes which are perpendicular to each other on the planar surface.

With this, acoustic waves can be radiated from piezoelectric speakers that are placed in order. Therefore, turbulence of acoustic waves can be reduced and desired directivity can be obtained.

An audio-visual apparatus may include a display unit configured to display video included in audio-visual content and the piezoelectric speaker array may be an audio-visual apparatus which radiates sound as the acoustic waves included in the audio-visual content.

With this, images and sound included in audio-visual content can be appropriately reproduced.

A sound reproduction panel according to the present invention may be an audio-visual apparatus which includes a package in which the piezoelectric speaker array is stored.

With this, the piezoelectric speaker array can be incorporated into a sound reproduction panel and be applied to various applications.

Moreover, a piezoelectric acoustic transducer according to the present invention may be a piezoelectric acoustic transducer which radiates acoustic waves by vibrating according to an applied voltage, including (i) a substrate which includes a first region having first bending stiffness against bending of a plane perpendicular to a vibration direction and a second region having second bending stiffness against bending of the perpendicular plane, the second bending stiffness being different from the first bending stiffness, (ii) a first piezoelectric element which is mounted on the first region and to which a voltage of a first frequency band is applied, and (iii) a second piezoelectric element which is mounted on the second region and to which a voltage of a second frequency band different from the first frequency band is applied.

With this structure, a voltage applied to piezoelectric elements can be converted into acoustic waves and the acoustic waves can be radiated to various media.

The present invention can secure a capacity of reproducing sound in a wide range even in a limited space. Moreover, the deterioration in sound quality can be reduced.

BRIEF DESCRIPTION OF THE DRAWINGS

These and other objects, advantages and features of the invention will become apparent from the following description thereof taken in conjunction with the accompanying drawings that illustrate a specific embodiment of the present invention. In the Drawings.

DESCRIPTION OF THE PREFERRED EMBODIMENTS

Figure 1:
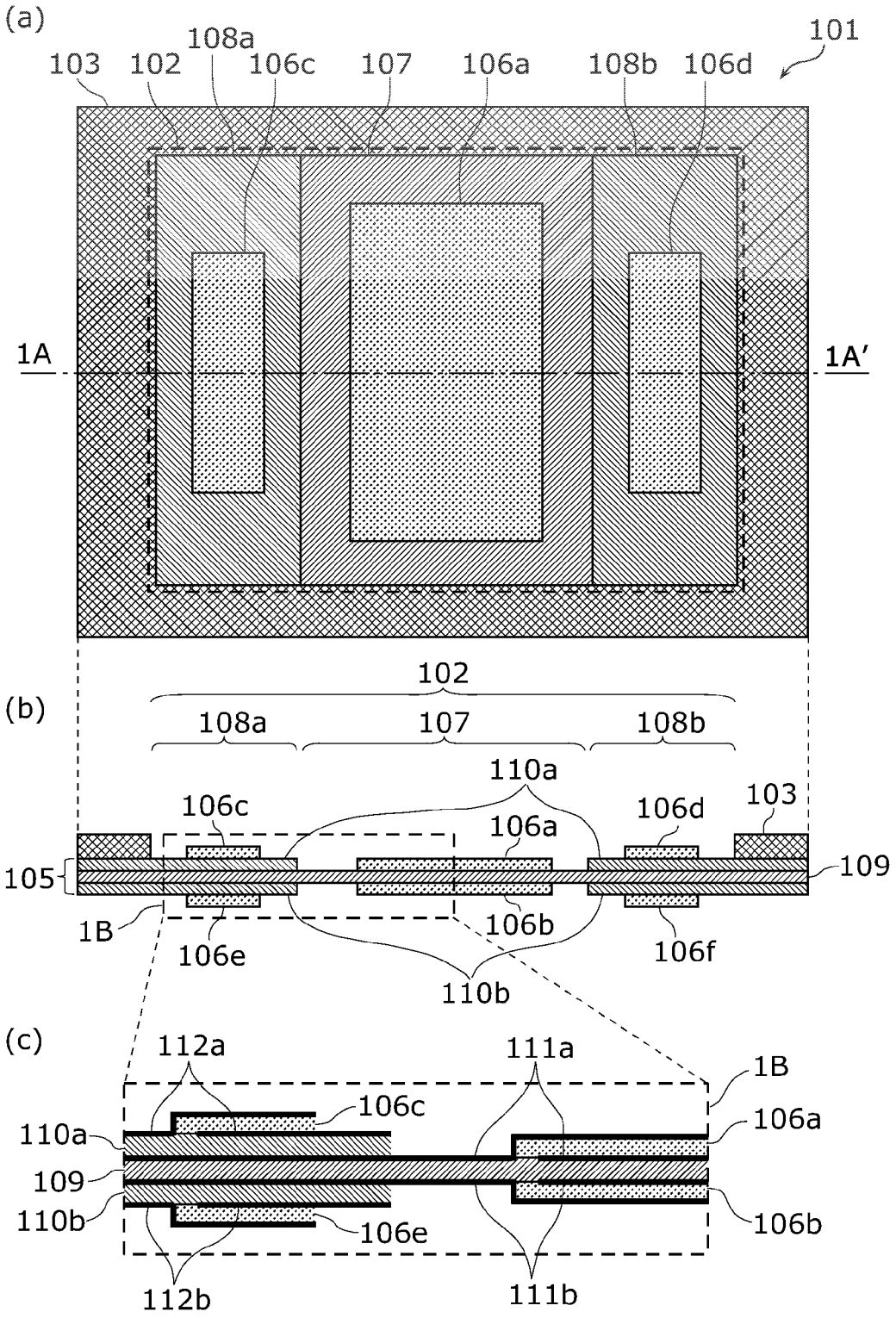
FIG. 1 is a diagram showing a piezoelectric speaker according to Embodiment 1.

Hereafter, the embodiments of the present invention will be described in detail with reference to drawings. It is noted that each of the embodiments shows a specific preferable example of the present invention. It is noted that a figure, a form, a material, a component, an arrangement position of components and a connection configuration, a step, a flow of steps, and the like are an example, and are not intended to limit the present invention. The present invention is limited only by the scope of claims. Therefore, among components according to the embodiments, components not shown in an independent claim 1indicating the broadest concept of the present invention are not necessarily required to achieve a goal of the present invention, but are described as components constituting a more preferable embodiment.

Moreover, in descriptions and drawings hereafter, overlapping descriptions will be omitted by assigning the same reference numerals to the same components.

Before the plural embodiments are described, common components according to the embodiments will be first described together among components according to the embodiments.

A piezoelectric element has a thin-plate piezoelectric material and an electrode layer, which is provided on two main surfaces of the piezoelectric material. The piezoelectric element may have sheets of a piezoelectric material, and an electrode layer sandwiched between each of the piezoelectric bodies.

A substrate is a plate-like material made of a sheet of a planar plate or laminated plane plates. The substrate includes a base material layer made of an insulating material and a circuit electrode layer on which the piezoelectric element is mounted. An exposed surface of the circuit electrode layer is made of a conductive material. The base material layer is typically made of a material that can be seen as an isotropic material.

An edge is made of a flexible material. For example, the edge may be made of either a flexible plastic material (polyethersulfone or the like) or a rubber-based polymer material (styrene butadiene rubber, nitrile butadiene rubber, acrylonitrile, or the like). Moreover, the edge may be formed in a film.

An external connection terminal is made of a member including a conductive material. For example, the external connection terminal may be made of any one or a combination of more than one of a group consisting of a metallic spring terminal, a flexible substrate, a connector, and a substrate member.

It is noted that an example of the above-mentioned common components and a structure different from the above-mentioned structure are acceptable. Moreover, the common components are not necessarily indispensable components.

(Embodiment 1)

FIG. 1 is a diagram showing a piezoelectric speaker according to Embodiment 1. In FIG. 1, a piezoelectric speaker 101 to radiate acoustic waves is illustrated. FIG. 1 illustrates, in (a), an upper surface of the piezoelectric speaker 101, and shows a front surface of a side of which acoustic waves are radiated from the piezoelectric speaker 101. FIG. 1 illustrates, in (b), a cross-sectional surface taken along line 1A-1A' shown in (a) of FIG. 1. FIG. 1 illustrates, in (c), an enlarged image of a portion 1B shown in (b) of FIG. 1 and a cross-sectional surface of an electrode structure.

As shown in FIG. 1, the piezoelectric speaker 101 includes a piezoelectric diaphragm 102 and a frame 103. Moreover, the piezoelectric speaker 101 includes four external connection terminals 104*a* to 104*d* (not illustrated in FIG. 1).

The piezoelectric diaphragm 102 has a rectangular-like shape and includes a substrate 105 and piezoelectric elements 106*a* to 106*f*. Moreover, the piezoelectric diaphragm 102 is a portion which vibrates and radiates acoustic waves. It is noted that a direction of vibration is an up and down direction in (b) of FIG. 1.

The frame 103 has a frame-like shape along the periphery of the piezoelectric diaphragm 102 and is fixed to an upper surface of the substrate 105.

The substrate 105 includes base material layers 109, 110*a*, and 110*b*, and circuit electrode layers 111*a*, 111*b*, 112*a*, and 112*b*. The circuit electrode layers 111*a* and 111*b* are provided on two main surfaces of the base material layer 109. The circuit electrode layer 112*a* is provided on a main surface of the base material layer 110*a* (a main surface opposite to the base material layer 109). The circuit electrode layer 112*b* is provided on a main surface of the base material layer 110*b* (a main surface opposite to the base material layer 109). The base material layers 109, 110*a*, and 110*b* are formed of the same material.

The piezoelectric diaphragm 102 is divided into three regions of a bass-range sound reproduction region 107 and two treble-range sound reproduction regions 108*a* and 108*b*.

In the bass-range sound reproduction region 107, the piezoelectric elements 106*a* and 106*b* are fixed to the base material layer 109 via the circuit electrode layers 111*a* and 111*b*. In the treble-range sound reproduction regions 108*a* and 108*b*, the piezoelectric elements 106*c* to 106*f* are fixed to the base material layers 110*a* and 110*b* via the circuit electrode layers 112*a* and 112*b*.

Figure 2:
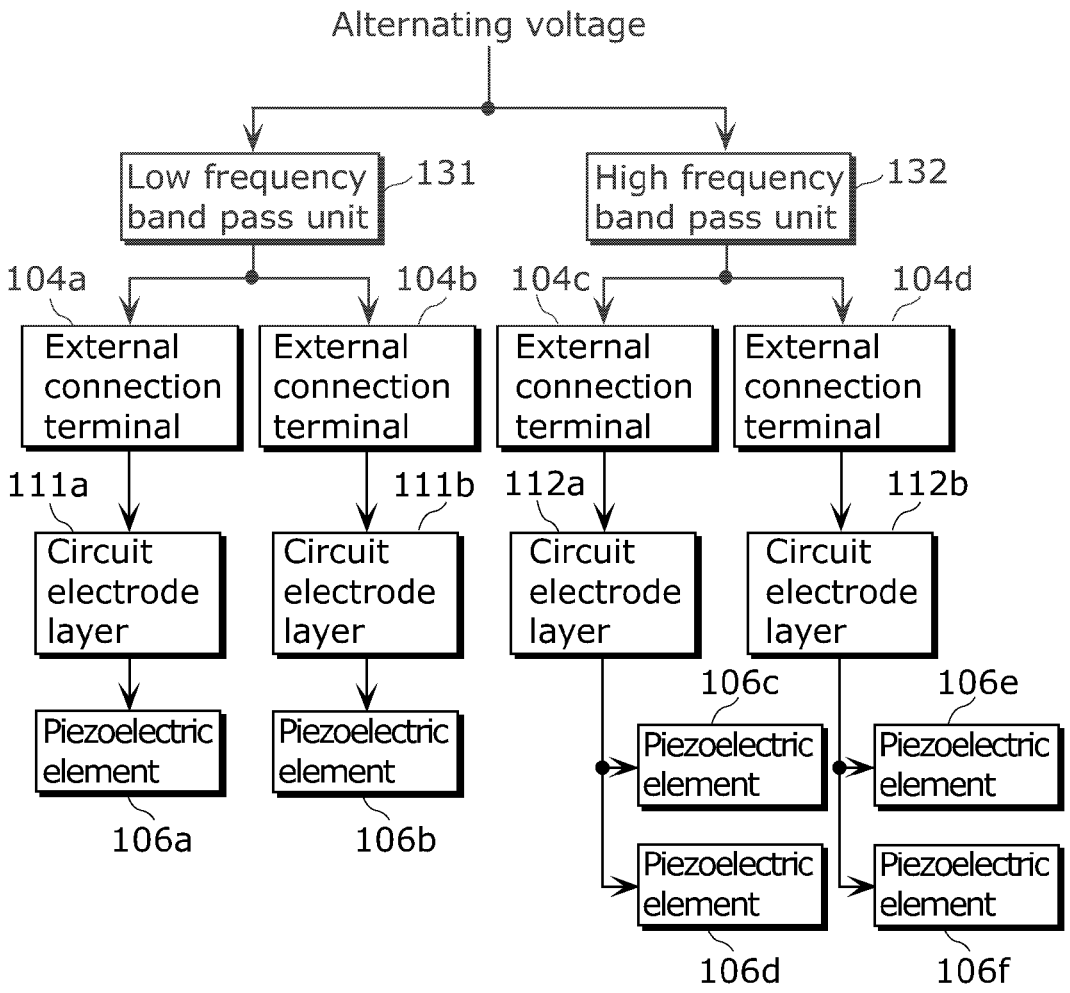
FIG. 2 is a diagram showing connection configurations of plural components according to Embodiment 1.

FIG. 2 is a diagram showing an electrical connection configuration of the plural components illustrated in FIG. 1. The piezoelectric element 106*a* is connected to the external connection terminal 104*a* via the circuit electrode layer 111*a*. The piezoelectric element 106*b* is connected to the external connection terminal 104*b* via the circuit electrode layer 111*b*. The piezoelectric elements 106*c* and 106*d* are connected to the external connection terminal 104*c* via the circuit electrode layer 112*a*. The piezoelectric elements 106*e* and 106*f* are connected to the external connection terminal 104*d* via the circuit electrode layer 112*b*.

An alternating voltage is applied to the external connection terminals 104*a* and 104*b* via a low frequency band pass unit 131. An alternating voltage is applied to the external connection terminals 104*c* and 104*d* via a high frequency band pass unit 132. With this, an alternating voltage can be applied to the piezoelectric elements 106*a* to 106*f*. It is noted that the external connection terminals 104*a* to 104*d* are provided on a peripheral portion of the substrate 105.

Figure 3:
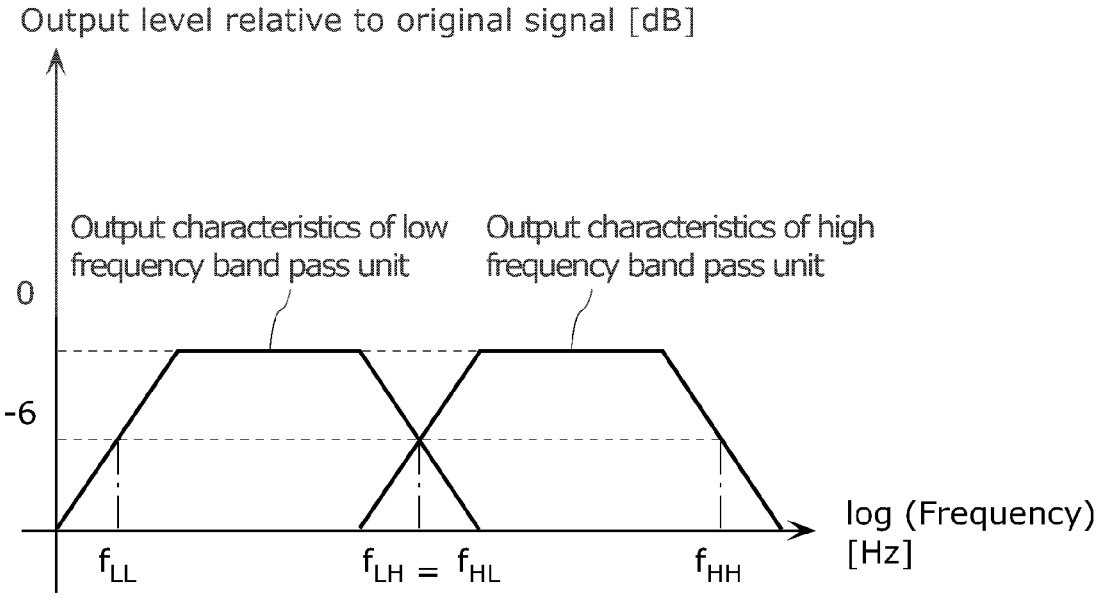
FIG. 3 is a graph showing output characteristics of a low frequency band pass unit and a high frequency band pass unit according to Embodiment 1.

FIG. 3 is a graph showing output characteristics of the low frequency band pass unit 131 and the high frequency band pass unit 132, both illustrated in FIG. 2. The low frequency band pass unit 131 outputs an alternating voltage of a relatively low frequency band ($f_{LL}$ to $f_{LH}$) The high frequency band pass unit 132 outputs an alternating voltage of a relatively high frequency band ($f_{HL}$ to $f_{HH}$). It is noted that it is preferable that an upper limit ($f_{LH}$) of an output frequency band of the low frequency band pass unit 131 and a lower limit ($f_{HL}$) of an output frequency band of the high frequency band pass unit 132 be set to be identical so as to realize a smooth output switchover.

A polarity of an alternating voltage given to the piezoelectric elements 106*a* and 106*b* is set according to a polarity of a circuit side and a direction of polarization of the piezoelectric elements 106*a* and 106*b* such that when the piezoelectric element 106*a* extends along a main surface, the piezoelectric element 106*b* contracts along the main surface. A polarity of an alternating voltage given to the piezoelectric elements 106*c* to 106*f* is also set such that a pair of piezoelectric elements facing each other across the substrate 105 contracts in opposite directions with each other along the main surface.

Furthermore, a thickness of the substrate 105 is designed such that a thickness of portions to which the piezoelectric elements 106*c* to 106*f* are fixed is greater than a thickness of portions to which the piezoelectric elements 106*a* and 106*b* are fixed.

Moreover, each of the regions is designed such that an area of the bass-range sound reproduction region 107 is greater than each of the areas of the treble-range sound reproduction regions 108*a* and 108*b* and that a planar form (width, length, and the like) corresponding to the bass-range sound reproduction unit 107 includes the planar forms corresponding to each of the treble-range sound reproduction regions 108*a* and 108*b*.

Hereafter, an operation at a time when an alternating current signal is applied to the piezoelectric speaker 101 including such a structure will be described. Typically, different signals for controlling directivity are inputted to the treble-range sound reproduction regions 108*a* and 108*b*. However, here, so as to make it easier to understand, description will be made assuming that the same signal is inputted to the treble-range sound reproduction regions 108*a* and 108*b*.

An original signal of an alternating current, which is outputted from a non-illustrated signal source, is converted into a bass-range sound reproduction signal by the low frequency band pass unit 131 having output characteristics shown in FIG. 3. Later, the bass-range sound reproduction signal is applied to the external connection terminals 104*a* and 104*b* as an alternating voltage VL. Moreover, the same original signal is converted into a treble-range sound reproduction signal by the high frequency band pass unit 132 having output characteristics shown in FIG. 3. Later, the treble-range sound reproduction signal is applied to the external connection terminals 104*c* and 104*d* as an alternating voltage VH.

As a result, the alternating voltage VL is applied to the piezoelectric elements 106*a* and 106*b* of the bass-range sound reproduction region 107. Then, an alternating voltage VH is applied to the piezoelectric elements 106*c* to 106*f* of the treble-range sound reproduction regions 108*a* and 108*b*.

Here, a low-pitched sound reproduction limit for the piezoelectric speaker 101 depends on a fundamental resonance frequency of bending vibration of the piezoelectric diaphragm 102. The fundamental resonance frequency of bending vibration of the piezoelectric diaphragm 102 varies according to bending stiffness and measurement of the piezoelectric diaphragm 102.

For example, assume that in the bass-range sound reproduction region 107, bending stiffness against bending of a neutral surface of the substrate 105 in portions to which the piezoelectric elements 106*a* and 106*b* are fixed is EI1. Moreover, assume that in the treble-range sound reproduction regions 108*a* and 108*b*, bending stiffness against bending of a neutral surface of the substrate 105 in portions to which the piezoelectric elements 106*c* to 106*f* are fixed is EI2.

Then, as shown in FIG. 1, a thickness of the substrate 105 is designed such that a thickness of portions to which the piezoelectric elements 106*c* to 106*f* are fixed is greater than a thickness of portions to which the piezoelectric elements 106*a* and 106*b* are fixed. In this case, EI1 and EI2 satisfy a relationship of Expression 1.

$$EI1<EI2 \quad \text{(Expression 1)}$$

Here, supposedly, in the case where each of the planar forms of the bass-range sound reproduction region 107 and the treble-range sound reproduction regions 108*a* and 108*b* is the same, based on the relationship of bending stiffness (Expression 1), a fundamental resonance frequency of the bass-range sound reproduction region 107 is lower than a fundamental resonance frequency of the treble-range sound reproduction regions 108*a* and 108*b*.

In this way, the piezoelectric speaker 101 is designed such that an area of the bass-range sound reproduction region 107 is larger than each of the areas of the treble-range sound reproduction regions 108*a* and 108*b* and that a planar form of the bass-range sound reproduction region 107 includes each of the planar forms of the treble-range sound reproduction regions 108*a* and 108*b*. With this structure, a fundamental resonance frequency of the bass-range sound reproduction region 107 is lower than a fundamental resonance frequency of the treble-range sound reproduction regions 108*a* and 108*b*.

Moreover, the bass-range sound reproduction region 107 is designed such that the fundamental resonance frequency is compatible with output characteristics of the low frequency band pass unit 131. Specifically, the bass-range sound reproduction region 107 is designed such that the fundamental resonance frequency of the bass-range sound reproduction region 107 is compatible with a lower limit ($f_{LL}$) of an output frequency band of the low frequency band pass unit 131.

Likewise, the treble-range sound reproduction regions 108*a* and 108*b* are designed such that a fundamental resonance frequency is compatible with output characteristics of the high frequency band pass unit 132. Specifically, the treble-range sound reproduction regions 108*a* and 108*b* are designed such that the fundamental resonance frequency of the treble-range sound reproduction regions 108*a* and 108*b* is compatible with the lower limit ($f_{HL}$) of an output frequency band of the high frequency band pass unit 132.

Conversely, so as to be compatible with the fundamental resonance frequency of the bass-range sound reproduction region 107 and the fundamental resonance frequency of the treble-range sound reproduction regions 108*a* and 108*b*, the output frequency bands of the low frequency band pass unit 131 and the high frequency band pass unit 132 may be determined.

With the above mentioned design, the low-pitched sound reproduction limits for the bass-range sound reproduction region 107 and the treble-range sound reproduction regions 108*a* and 108*b* and lower limits of frequency bands of alternating voltages VL and VH are compatible. Therefore, the piezoelectric speaker 101 can secure reproduction performance of a wide sound range corresponding to the frequency bands of the alternating voltages VL and VH.

Next, a reduction in deterioration in sound quality will be described. A displacement of the piezoelectric diaphragm 102 decreases inversely with a frequency. Therefore, the displacement of the treble-range sound reproduction regions 108*a* and 108*b* is sufficiently small relative to a displacement of the bass-range sound reproduction region 107. Therefore, an operation of the treble-range sound reproduction regions 108*a* and 108*b* has little influence on an operation of the bass-range sound reproduction region 107. Moreover, because there is a distance, an operation of one of the treble-range sound reproduction regions 108*a* and 108*b* has small influence on an operation of the other.

Furthermore, a thickness of the piezoelectric diaphragm 102 is designed as shown in (b) of FIG. 1. In other words, a thickness of the bass-range sound reproduction region 107 is different from a thickness of each of the treble-range sound reproduction regions 108*a* and 108*b*, and a variation in the thickness is discontinuous. Therefore, transmission of bending waves is reduced compared with a plate having a uniform material of which a variation in thickness is continuous. Therefore, an operation of each of the regions has little influence on operations in other regions.

The piezoelectric speaker 101 composed as described above can reduce interference between the operation of the bass-range sound reproduction region 107 and the operations of the treble-range sound reproduction regions 108*a* and 108*b*, even though there is only one unit of the piezoelectric diaphragm 102. Therefore, the piezoelectric speaker 101 can maintain sound quality even though signals independent with each other are reproduced.

Next, the thinning or miniaturization of the piezoelectric speaker 101 will be described. The piezoelectric speaker 101, which has only one unit of the piezoelectric diaphragm 102, is smaller itself than in the case where piezoelectric diaphragms are used. For example, in the case where plural piezoelectric diaphragms are used, the number increases for components including a supporting member to support the plural piezoelectric diaphragms. Therefore, the plural piezoelectric diaphragms are required to have a larger space. Meanwhile, the piezoelectric speaker 101 made of one unit of the piezoelectric diaphragm 102 is applicable to a limited space.

Moreover, as shown in (c) of FIG. 1, the circuit electrode layer 111*a* is formed between the base material layer 109 and the base material layer 110*a*. Then, the circuit electrode layer 111*b* is formed between the base material layer 109 and the base material layer 110*b*. The circuit electrode layers 111*a* and 111*b* provide a voltage to the bass-range sound reproduction region 107. Meanwhile, the circuit electrode layer 112*a* is formed on the base material layer 110*a*. Then, the circuit electrode layer 112*b* is formed on the base material layer 110*b*. The circuit electrode layers 112*a* and 112*b* provide a voltage to the treble-range sound reproduction regions 108*a* and 108*b*.

Specifically, for example, the circuit electrode layer 111*a* applies a voltage to both sides of the piezoelectric element 106*a* by two polarities which are different with each other. This allows the piezoelectric element 106*a* to be elastic. The circuit electrode layer 111*a* is not electrically connected to the circuit electrode layer 112*a* because the circuit electrode layer 111*a* runs through between the base material layer 109 and the base material layer 110*a*. In addition, the circuit electrode layer 111*a* can apply a voltage to the piezoelectric element 106*a* without being electrically connected to the circuit electrode layer 112*a*.

With this structure, each of the signals independent by a circuit formed on plural layers of an electrode pattern is provided to corresponding piezoelectric elements. Connection to a circuit of which a voltage is applied to each of the piezoelectric elements becomes possible at an edge of the substrate 105. Therefore, a circuit for the treble-range sound and wiring of an electric circuit for the bass-range sound are simplified. Therefore, a required space is decreased, the thinning of the piezoelectric speaker 101 becomes possible, and a lower cost of the piezoelectric speaker 101 becomes possible.

As described above, the piezoelectric speaker 101 can secure a reproduction capacity in a wide sound range and reduce deterioration in sound quality in a limited space. Moreover, an effect of directivity can be obtained because plural sound sources are mounted.

It is noted that the above description shows a structure of which the treble-range sound reproduction regions 108*a* and 108*b* are adjacent to a pair of opposite sides of the bass-range sound reproduction region 107. However, an arrangement in each of the regions is not limited to this. For example, each of the regions may be placed such that the treble-range sound reproduction regions 108*a* and 108*b* are adjacent to any of the sides of the bass-range sound reproduction region 107.

In this case, influence of an operation of one of the treble-range sound reproduction regions 108*a* and 108*b* on the other is larger than with a structure of which the treble-range sound reproduction regions 108*a* and 108*b* are adjacent to an opposite side of the bass-range sound reproduction region 107. Meanwhile, an interval between the treble-range sound reproduction regions 108*a* and 108*b* becomes narrower. Therefore, this structure is effective in the case where an improvement in performance of directivity control by interval contraction is greater than deterioration in the performance of directivity control by operation interference.

Moreover, the output characteristics of the low frequency band pass unit 131 and the high frequency band pass unit 132 are not limited to damping characteristics of a linear shape as shown in FIG. 3. For example, the low frequency band pass unit 131 and the high frequency band pass unit 132 may have output characteristics of which sound pressure in the whole of a reproduction frequency band becomes planarized based on frequency response characteristics when an original signal is inputted to each of the bass-range sound reproduction region 107 and the treble-range sound reproduction regions 108*a* and 108*b*.

With this, sound pressure of signals outputted from the bass-range sound reproduction region 107 and the treble-range sound reproduction regions 108*a* and 108*b* can be planarized in the whole of the reproduction frequency band. Therefore, adjustment in an external circuit or an external computing unit used for controlling directivity becomes easier. Therefore, cost reduction in a directivity control unit becomes possible.

Moreover, in the above description, a signal which has passed through the low frequency band pass unit 131 and the high frequency band pass unit 132 is provided, as alternating voltages VL and VH, to piezoelectric elements on both surfaces of the bass-range sound reproduction region 107 and the treble-range sound reproduction regions 108*a* and 108*b*. However, a voltage, which is obtained by applying an offset voltage to at least one of the alternating voltages VL and VH, may be applied to any of the piezoelectric elements.

For example, the low frequency band pass unit 131 generates, based on an offset voltage (Vd), two alternating voltages (VL+Vd, −VL+Vd) from the alternating voltage VL. Then, the two alternating voltages are applied to the piezoelectric elements 106*a* and 106*b*, respectively. This allows the piezoelectric elements 106*a* and 106*b* to avoid depolarization, resulting in expansion of an input range of voltage.

Moreover, the circuit electrode layers 111*a*, 111*b*, 112*a*, and 112*b*, which are connected to both surfaces of the piezoelectric elements 106*a* and 106*b*, are insulated from each other by the base material layers 109, 110*a*, and 110*b*. Therefore, an independent signal is easily applied without use of another wiring unit.

Moreover, in the above description, bending stiffness of the substrate 105 varies according to a difference in a thickness caused by lamination of the base material layers 109, 110*a*, and 110*b*. However, the variation in bending stiffness may be embodied by something other than a thickness. For example, the base material layers 109, 110*a*, and 110*b* may be made of materials having bending Young's moduli different from each other. With this, the variation in the bending stiffness can be embodied.

Moreover, the base material layers 109, 110*a*, and 110*b* are not required to be made of a uniform material whose surface is flat. For example, the variation in the bending stiffness may be embodied by forming a cavity inside the base material layers 109, 110*a*, and 110*b* and forming concavity and convexity on the surfaces of the base material layers 109, 110*a*, and 110*b*.

Then, it becomes easier to set, at a desired frequency, the low-pitched sound reproduction limits for the bass-range sound reproduction region 107 and the treble-range sound reproduction regions 108*a* and 108*b* by selecting appropriate materials and structures for the base material layers 109, 110*a*, and 110*b*.

It is noted that a lightweight material may be used for the base material layers 109, 110*a*, and 110*b* so as to improve voltage efficiency. Especially, a lightweight material may be used only for the base material layer 109 so as to improve voltage efficiency of a bass-range sound. Moreover, a material having high internal loss may be used for the base material layers 110*a* and 110*b* so as to planarize frequency response characteristics. Moreover, an additional mass may be given to part of exposed surfaces of the base material layers 110*a* and 110*b*.

Moreover, the above description shows an example where the treble-range sound reproduction regions 108*a* and 108*b* are connected to the external connection terminals 104*c* and 104*d* at the peripheral portion of the frame 103 via the circuit electrode layers 112*a* and 112*b*. However, a circuit providing a voltage is not limited to this structure. For example, through holes may be made in parts of the base material layers 109, 110*a*, and 110*b*. Then, the circuit providing a voltage may be electrically connected, at an optional position, to the circuit electrode layers 111*a*, 111*b*, 112*a*, and 112*b*.

Moreover, all of the bass-range sound reproduction region 107 and the treble-range sound reproduction regions 108*a* and 108*b* may be connected to the external connection terminals 104*a* to 104*d* via the circuit electrode layers 111*a* and 111*b*.

(Embodiment 2)

Embodiment 2 shows an example where the piezoelectric speaker 101 according to Embodiment 1 is applied to a piezoelectric speaker array.

Figure 4:
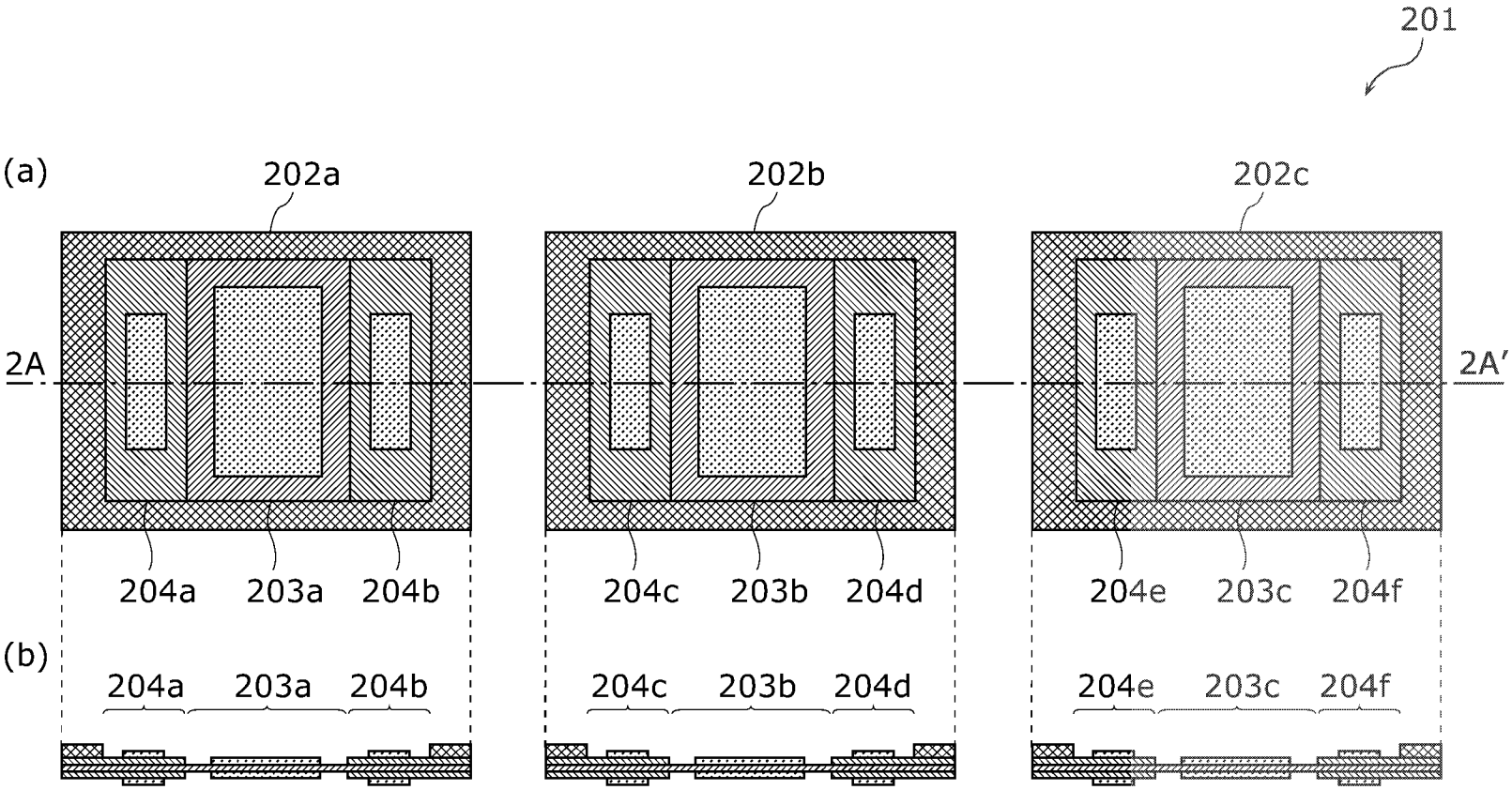
FIG. 4 is a diagram showing a piezoelectric speaker array according to Embodiment 2.

FIG. 4 is a diagram showing a piezoelectric speaker array according to Embodiment 2. FIG. 4 illustrates, in (a), a top surface of a piezoelectric speaker array 201. FIG. 4 illustrates, in (b), a cross-sectional surface of the piezoelectric speaker array 201. The piezoelectric speaker array 201 includes piezoelectric speakers 202*a* to 202*c* that are arranged in a linear fashion. Each of the piezoelectric speakers 202*a* to 202*c* has the same structure as the piezoelectric speaker 101 according to Embodiment 1.

The piezoelectric speakers 202*a* to 202*c* are arranged such that an interval is equal between the centers of treble-range sound reproduction regions 204*a* to 204*f* when the piezoelectric speaker array 201 is viewed in a radiation direction of acoustic waves. Control signals different from each other are provided to the treble-range sound reproduction regions 204*a* to 204*f*. The same bass-range sound reproduction signal is inputted to the bass-range sound reproduction regions 203*a* to 203*c*.

Moreover, in the piezoelectric speaker array 201, an interval between centers of the treble-range sound reproduction regions 204*a* to 204*f* is about half of the interval between centers of the bass-range sound reproduction regions 203*a* to 203*c*. With this, an effective effect of directivity can be obtained. Hereafter, the directivity will be described in detail.

Figure 5:
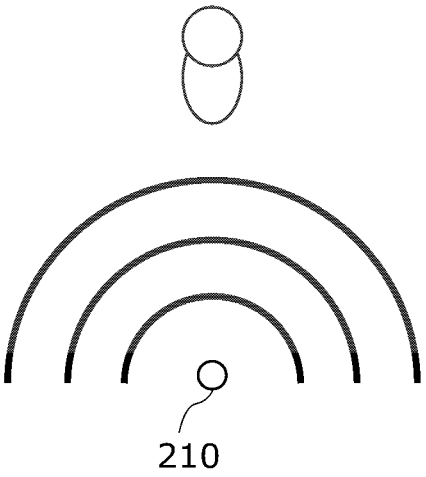
FIG. 5 is a diagram showing acoustic waves radiated from one sound source.

FIG. 5 is a diagram in which acoustic waves are radiated from one sound source. In FIG. 5, a sound source 210 is illustrated. As illustrated in FIG. 5, acoustic waves by the sound source 210 spread out. Therefore, effective directivity cannot be obtained.

Figure 6:
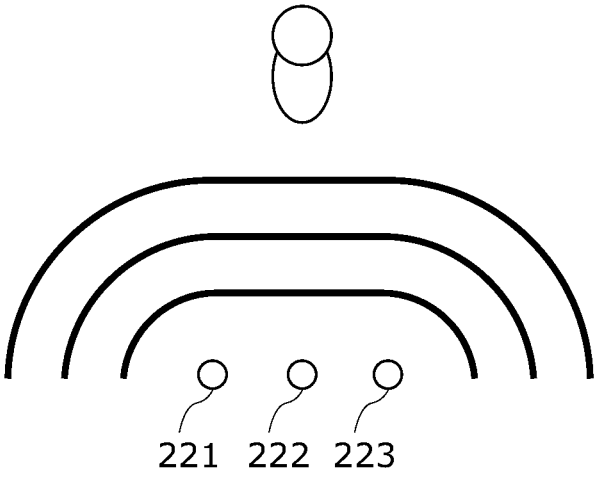
FIG. 6 is a diagram showing acoustic waves radiated from plural sound sources.

FIG. 6 is a diagram of which acoustic waves are radiated from plural sound sources. In FIG. 6, plural sound sources 221 to 223 are illustrated. As shown in FIG. 6, acoustic waves from the plural sound sources 221 to 223 are radiated in a predetermined direction. Therefore, the effective directivity can be obtained. Moreover, when an interval among the plural sound sources 221 to 223 is narrower, more stable directivity can be obtained. Therefore, each of the piezoelectric speakers 202*a* to 202*c* corresponding to the sound sources 221 to 223 is required to be miniaturized so as to narrow the interval.

Moreover, an interval of sound sources required to obtain effective effect of directivity is dependent on a wavelength (frequency) of acoustic waves. Specifically, the necessary sound source interval becomes narrower as the frequency become higher. Therefore, it is preferable that each of the sound sources be placed such that an interval between the sound sources in a treble-range sound is narrower than an interval between the sound sources in a bass-range sound. With this, deterioration in the directivity control performance can be reduced. Moreover, it is preferable that the sound sources be arranged at equal intervals. With this, turbulence of acoustic waves can be reduced and more effective directivity can be obtained.

In Embodiment 2, the bass-range sound reproduction regions 203*a* to 203*c* and the treble-range sound reproduction regions 204*a* to 204*f* are placed at equal intervals. Moreover, an interval between adjacent ones of the treble-range sound reproduction regions 204*a* to 204*f* is narrower than an interval between adjacent ones of the bass-range sound reproduction regions 203*a* to 203*c*. Therefore, the effective effect of directivity can be obtained.

Moreover, as similarly to Embodiment 1, the piezoelectric speakers 202*a* to 202*c* reduce operation interference between the bass-range sound reproduction regions 203*a* to 203*c* and the treble-range sound reproduction regions 204*a* to 204*f* by a variation in bending stiffness on a substrate. Then, the piezoelectric speakers 202*a* to 202*c* secure a low-pitched sound reproduction performance.

Therefore, the performance of directivity control is secured in a treble-range sound by a narrow interval of sound sources and control of operation interference. Moreover, sound pressure necessary to reproduce high sound quality of audio content is secured in a bass-range sound by the arranged bass-range sound reproduction regions 203*a* to 203*c* without providing another speaker for low-pitched sound.

Moreover, in the above description, control signals different from each other are inputted to only the treble-range sound reproduction regions 204*a* to 204*f*. However, the different control signals may be inputted to the bass-range sound reproduction regions 203*a* to 203*c*. For example, a stereo signal through a low-pass filter may be inputted. Moreover, control signals generated in accordance with the number of treble-range sound reproduction regions may be added or divided in accordance with the number of bass-range sound reproduction regions. Then the added or divided control signals may be provided.

Moreover, the piezoelectric speakers 202*a* to 202*c* may not be structurally independent. For example, the piezoelectric speakers 202*a* to 202*c* may share the same frame or the same power circuit.

(Embodiment 3)

In Embodiment 3, an edge (edge region) having a flexible material is provided on a long side portion inside the frame 103 according to Embodiment 1 and a peripheral portion of the bass-range sound reproduction region 107 according to Embodiment 1. The other components are similar to the components in Embodiment 1.

Figure 7:
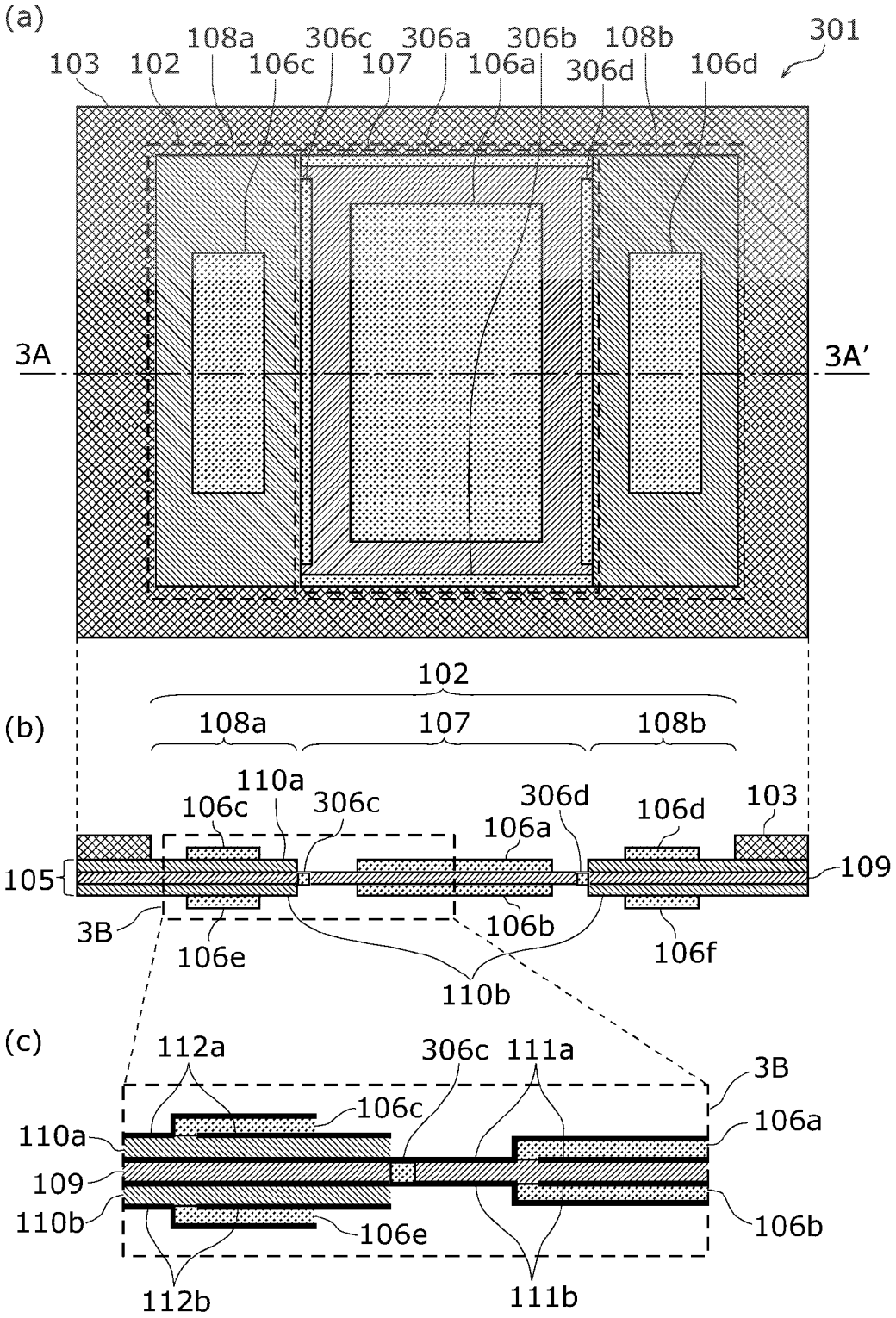
FIG. 7 is a diagram showing a piezoelectric speaker according to Embodiment 3.

FIG. 7 illustrates a piezoelectric speaker according to Embodiment 3. FIG. 7 illustrates, in (a), a top surface of a piezoelectric speaker 301. FIG. 7 illustrates, in (b), a cross-sectional surface taken along line 3A-3A'. FIG. 7 illustrates, in (c), an enlarged image of a portion 3B shown in (b) of FIG. 7.

In the substrate 105, punching is performed for a long side inside the frame 103 and a peripheral portion of the bass-range sound reproduction region 107. Then, edges 306*a* to 306*d* are formed by filling the punched portions with the flexible material.

Most of the peripheral portion (four sides) of the bass-range sound reproduction region 107 is supported by edges 306*a* to 306*d* that are easily elastic. Then, the bass-range sound reproduction region 107 is connected to other regions via a corner portion of the bass-range sound reproduction region 107. Therefore, the whole of the bass-range sound reproduction region 107 including the peripheral portion is easier to vibrate with larger amplitude. Conclusively, reproduced sound pressure of a bass-range sound is greater.

Therefore, in addition to the effect of the piezoelectric speaker 101, performance of low-pitched sound reproduction is further improved in the piezoelectric speaker 301.

It is noted that, in the above description, the edges 306*a* to 306*d* are formed by filling the punched portions of the substrate 105 with the flexible material. However, a method of forming the edges 306*a* to 306*d* is not limited to this.

For example, any or both of an upper surface and a lower surface of the piezoelectric speaker 301 may be covered with a covering material such as a flexible laminate material. Moreover, two base material layers treated with punching may be designed to hold a flexible laminate base material layer from both sides. This allows an intermediate base material layer to be formed. Then an exposed portion of the laminate base material layer may have a function as the edges 306*a* to 306*d*.

(Embodiment 4)

In Embodiment 4, treble-range sound reproduction regions are placed on a two-dimensional surface compared with Embodiment 1.

Figure 8:
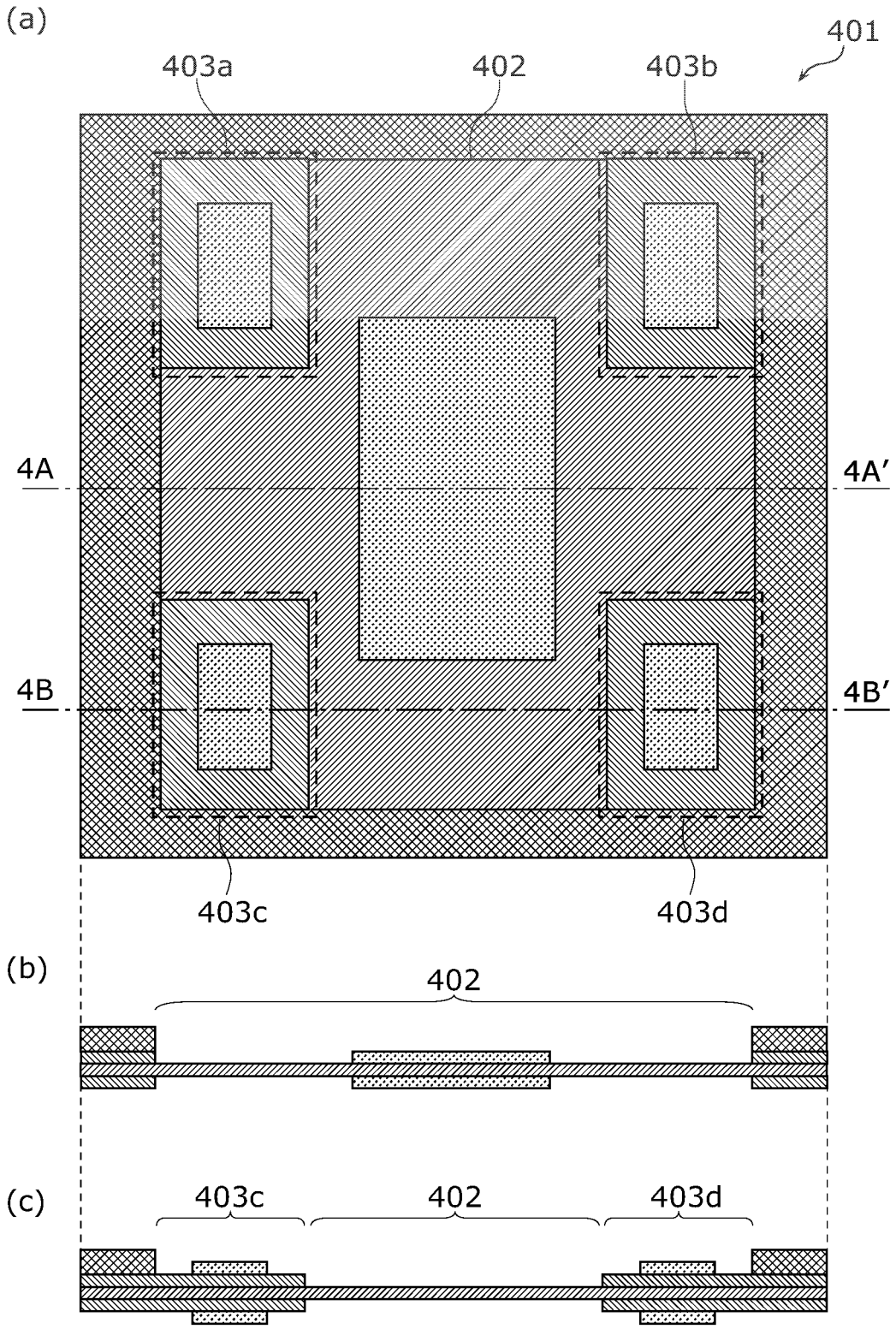
FIG. 8 is a diagram showing a piezoelectric speaker according to Embodiment 4.

FIG. 8 illustrates a piezoelectric speaker according to Embodiment 4. FIG. 8 illustrates, in (a), a top surface of a piezoelectric speaker 401. FIG. 8 illustrates, in (b), a cross-sectional surface taken along line 4A-4A' shown in (a) of FIG. 8. FIG. 8 illustrates, in (c), a cross-sectional surface taken along line 4B-4B' shown in (a) of FIG. 8. The piezoelectric speaker 401 is in form of an approximate square in a radiation direction of acoustic waves, including a bass-range sound reproduction region 402 and treble-range sound reproduction regions 403*a* to 403*d*.

The treble-range sound reproduction regions 403*a* to 403*d* are placed in two columns each in a perpendicular direction and a horizontal direction of (a) of FIG. 8. Then, independent sound source signals are given to the treble-range sound reproduction regions 403*a* to 403*d*. With this, directivity can be controlled in two perpendicular axis directions. Therefore, the piezoelectric speaker 401 has an effect obtained from the piezoelectric speaker 101 and can provide an appropriate sound according to listening positions in a horizontal direction and a height direction.

It is noted that in the above description the piezoelectric speaker 401 has an approximate square. This makes it easier for the piezoelectric speaker 401 to be placed. However, the piezoelectric speaker 401 may not have the approximate square shape. Moreover, an arrangement of the regions is not limited to the above example.

(Embodiment 5)

Embodiment 5 shows an example where a piezoelectric speaker array is applied to a speaker of an audio-visual apparatus.

Figure 9:
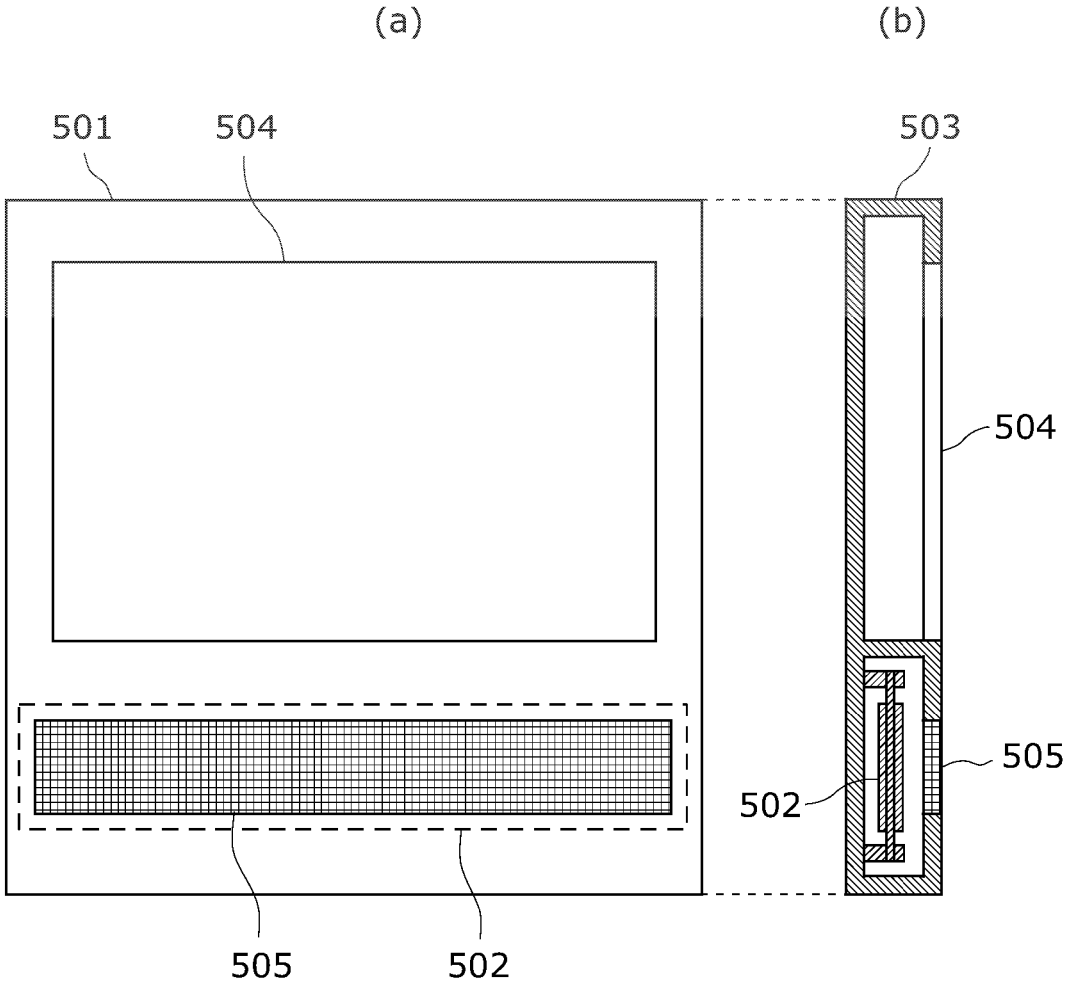
FIG. 9 is a diagram showing an audio-visual apparatus according to Embodiment 5.

FIG. 9 is a diagram showing an audio-visual apparatus according to Embodiment 5. FIG. 9 illustrates, in (a), a front face of an audio-visual apparatus 501. FIG. 9 illustrates, in (b), a cross-sectional surface of the audio-visual apparatus 501.

The audio-visual apparatus 501 includes a piezoelectric speaker array 502 inside a package 503. The piezoelectric speaker array 502 radiates sound from an opening 505 formed under a display unit 504. The piezoelectric speaker array 502 is configured similarly to the piezoelectric speaker array 201. In addition, the piezoelectric speaker array 502 may be a speaker array in which the piezoelectric speakers 301 and 401 are arranged, instead of the piezoelectric speaker 101, or in which a combination of the piezoelectric speakers 101, 301, and 401 is arranged.

The piezoelectric speaker array 502, even in a small space, has an effect similar to the effect produced when a low-pitched sound speaker and a middle and high-pitched sound speaker are formed on the same substrate. Therefore, the audio-visual apparatus 501 can secure a volume of a bass-range sound necessary to reproduce audio-visual content without increasing a thickness of the package 503.

Moreover, the piezoelectric speaker array 502 is composed such that piezoelectric speakers having a bass-range sound reproduction region and a treble-range sound reproduction region are arranged. Therefore, the piezoelectric speaker array 502 also has an effect similar to the effect produced when plural low-pitched sound speakers and plural middle and high-pitched sound speakers are placed in an array.

Furthermore, the piezoelectric speaker array 502 can have a similar effect with a smaller number of components, compared with a configuration in which plural low-pitched sound speakers and middle and plural high-pitched sound speakers are placed. Therefore, cost in a speaker portion of the audio-visual apparatus 501 can be reduced. Then a function of sending necessary sound to a listener in a specific direction is realized at a low cost.

It is noted that in the audio-visual apparatus 501 according to Embodiment 5, the piezoelectric speaker array 502 is provided under the display unit 504. However, the position of the piezoelectric speaker array 502 is not limited to this. The piezoelectric speaker array 502, for example, may be provided above the display unit 504. Or, the piezoelectric speaker array 502 may be provided under and above the display unit 504. With this, a sense of an up and down direction of sound and images can be controlled.

Furthermore, the piezoelectric speaker array 502, for example, may be provided at a portion other than the package 503. For example, the piezoelectric speaker array 502 may be provided at a base portion such that the package 503 is fixed on a horizontal plane. Or, the piezoelectric speaker array 502 may be provided inside a fixing unit such as an arm for holding the package 503 in a stationary body.

(Embodiment 6)

Embodiment 6 shows an example where a piezoelectric speaker array is applied to a speaker of a sound reproduction panel. Here, the sound reproduction panel refers to a plate-shaped structure for an exclusive use of sound reproduction, a plate-shaped structure having a visual information display function and a sound reproduction function, a reproduction apparatus functioning as a part of furniture, or a building material module, such as a partition, a wall, or a ceiling, having a reproduction function.

Figure 10:
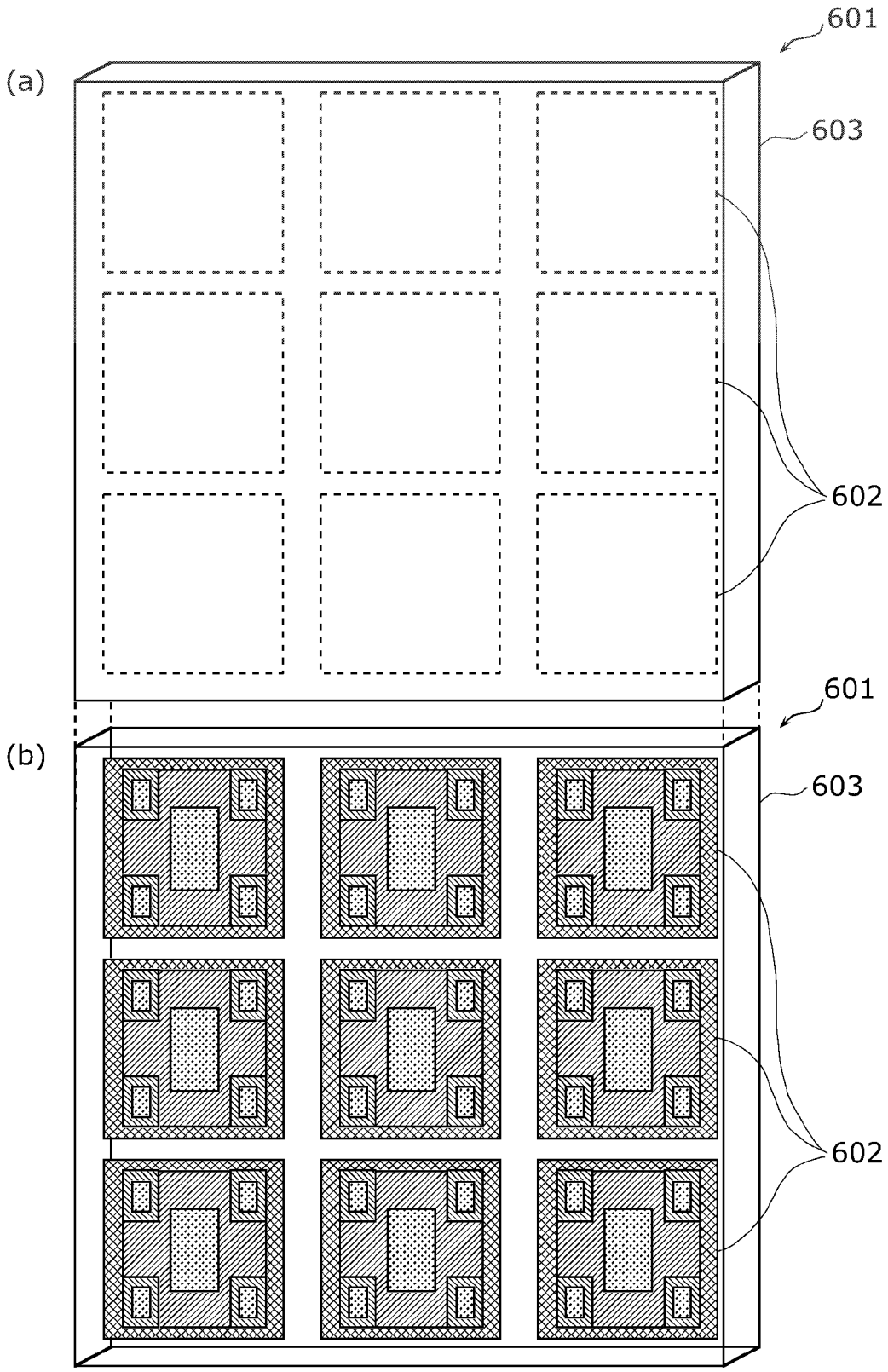
FIG. 10 is a diagram showing a sound reproduction panel according to Embodiment 6.

FIG. 10 is a diagram showing a sound reproduction panel according to Embodiment 6. A sound reproduction panel 601 shown in FIG. 10 includes plural piezoelectric speakers 602 and a package 603. FIG. 10 shows, in (a), an outer appearance of the sound reproduction panel 601. FIG. 10 shows, in (b), an inside of the sound reproduction panel 601.

A configuration of the package 603 has a thin box-like shape of an approximate square. Inside the package 603, the plural piezoelectric speakers 602 are arranged in three rows in a horizontal direction and in three columns in a perpendicular direction. A front surface side of the package 603 is mainly made of a material which easily transmits acoustic waves radiated from the plural piezoelectric speakers 602. The other surfaces include materials and structures satisfying strength necessary to fix the plural piezoelectric speakers 602 within the panel and install the sound reproduction panel 601 in an installation site.

The plural piezoelectric speakers 602 form a piezoelectric speaker array. Each of the plural piezoelectric speakers 602, for example, is configured similarly to the piezoelectric speaker 401. Moreover, each of the plural piezoelectric speakers 602 may be configured similarly to the piezoelectric speaker 101 or the piezoelectric speaker 301 instead of the piezoelectric speaker 401.

In the sound reproduction panel 601, the plural piezoelectric speakers 602 are configured to form a row and a column along a horizontal direction and a perpendicular direction. This allows the sound reproduction panel 601 to have an effect similar to the effect from a configuration in which low-pitched sound speakers and middle and high-pitched sound speakers are two-dimensionally placed. Therefore, control of directivity of acoustic waves becomes easy. Moreover, the control of the directivity results in a decrease in noise of a bass-range sound.

Moreover, in the case where the piezoelectric speaker 401 is used in each of the plural piezoelectric speakers 602, treble-range sound reproduction regions are more closely placed on a panel in a two-dimensional direction. An independent control signal is applied to each of these treble-range sound reproduction regions. With this, control of directivity in a two-dimensional direction can be realized in acoustic waves radiated from the front surface of the panel.

Therefore, the sound reproduction panel 601 can provide a listener with appropriate sound information and content in a desired space range. Moreover, it is easier to reduce noise.

It is noted that a configuration of the package 603 is not limited to a thin box-like shape in an approximate square. For example, a configuration of the package 603 may be designed according to an installation site.

(Embodiment 7)

Embodiment 7 shows how to design a piezoelectric speaker. In Embodiment 7, a designing method is shown based on the piezoelectric speaker 101 according to Embodiment 1 and plural components of the piezoelectric speaker 101. The designing method shown in Embodiment 7 may be applied to methods of designing piezoelectric speakers according to other embodiments.

Figure 11:
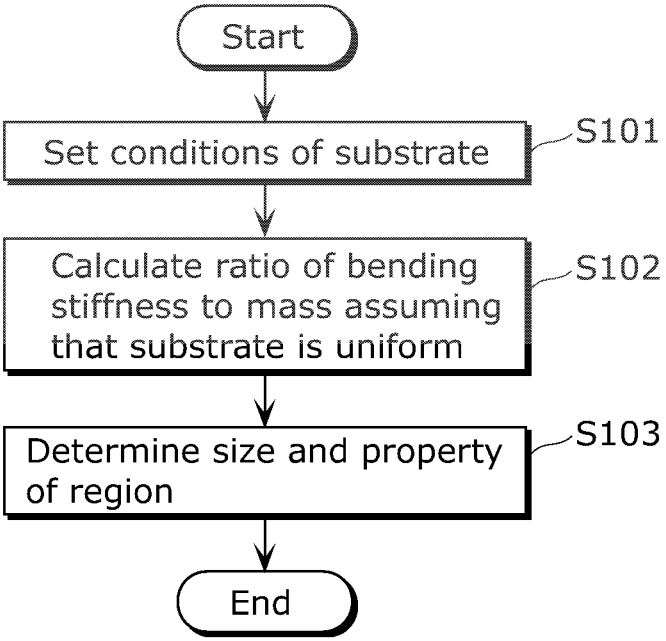
FIG. 11 is a flowchart showing steps of designing a piezoelectric speaker according to Embodiment 7.

FIG. 11 is a flowchart showing steps of designing the piezoelectric speaker 101 according to Embodiment 7. First, conditions of the substrate 105 are set (S101). For example, an outer measurement of the piezoelectric diaphragm 102, a peripheral fixation condition (border condition) for the piezoelectric diaphragm 102, properties of the piezoelectric elements 106*a* to 106*f* (density and Young's modulus), a thickness of the piezoelectric elements 106*a* to 106*f*, a fundamental resonance frequency of the piezoelectric speaker 101, and the like are set. These may be determined based on requirements of the piezoelectric speaker 101.

As a specific example, the outer measurement of the piezoelectric diaphragm 102 having a rectangular shape is set at 22 mm in width by 62 mm in length. Moreover, the peripheral fixation condition for the piezoelectric diaphragm 102 is set as fixation of short sides and freedom of long sides. In other words, two short sides of the piezoelectric diaphragm 102 are set such that the short sides are fixed not to vibrate. Meanwhile, two long sides of the piezoelectric diaphragm 102 are set not to be fixed.

Moreover, as a specific example, density ($\rho_p$) of each of the piezoelectric elements 106*a* to 106*f* is set at 7,900 kg/m$^3$ based on materials of the piezoelectric elements 106*a* to 106*f*. Moreover, the Young's modulus ($E_p$) of each of the piezoelectric elements 106*a* to 106*f* is set at 71 GPa. Moreover, a thickness ($t_p$) of each of the piezoelectric elements 106*a* to 106*f* is set at 50 μm. Moreover, a fundamental resonance frequency ($f_1$) of the piezoelectric speaker 101 is set at 260 Hz.

Next, assuming that the substrate 105 is uniform, a ratio (EI/ρA) of bending stiffness (EI) to a mass per unit length (ρA) in the piezoelectric diaphragm 102 is calculated (S102).

Figure 12:
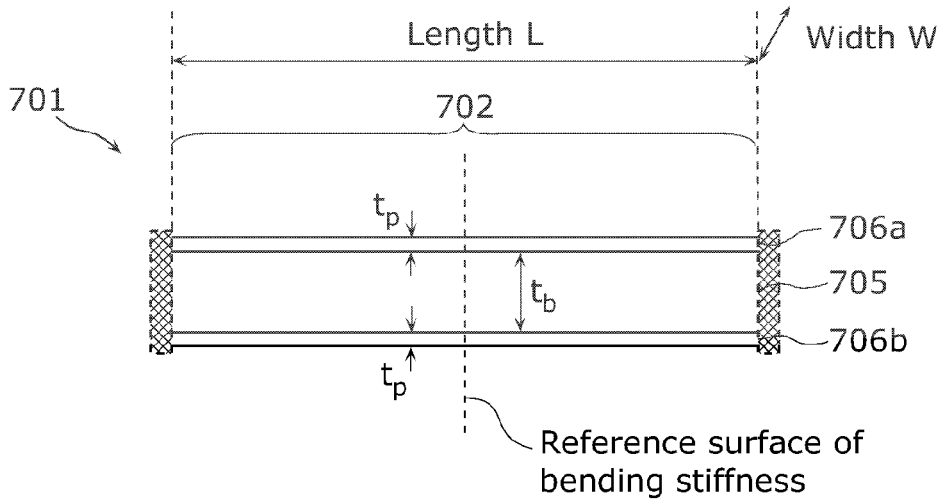
FIG. 12 is a diagram showing a first example of a piezoelectric speaker according to Embodiment 7.

FIG. 12 is a diagram showing a piezoelectric speaker having a uniform substrate. A piezoelectric speaker 701 shown in FIG. 12 includes, on a piezoelectric diaphragm 702, a uniform substrate 705 and piezoelectric elements 706*a* and 706*b*. A length of the piezoelectric diaphragm 702 is L and a width of the piezoelectric diaphragm 702 is W. Moreover, a thickness of the substrate 705 is $t_b$. A thickness of each of the piezoelectric elements 706*a* and 706*b* is $t_p$. In this case, bending stiffness (EI) on a reference surface of the piezoelectric diaphragm 702 satisfies Expression 2.

(Math. 1)

$$EI = E_b I_b + E_p I_p = \frac{W}{12}\{E_b t_b^3 + E_p(6t_b t_p^2 + 3t_b^2 t_p + t_p^3)\} \quad \text{(Expression 2)}$$

Here, E represents the Young's modulus of the piezoelectric diaphragm 702, I represents a cross-sectional secondary moment of the piezoelectric diaphragm 702, $E_b$ represents the Young's modulus of the substrate 705, $I_b$ represents a cross-sectional secondary moment of the substrate 705, $E_p$ represents the Young's modulus of each of the piezoelectric elements 706*a* and 706*b*, and $I_p$ represents a cross-sectional secondary moment of each of the piezoelectric elements 706*a* and 706*b*.

Moreover, the mass per unit length (ρA) of the piezoelectric diaphragm 702 satisfies Expression 3.

$$\rho A = W(\rho_b t_b + 2\rho_p t_p) \quad \text{(Expression 3)}$$

Here, ρ represents density of the piezoelectric diaphragm 702, A represents a cross-sectional area of the piezoelectric diaphragm 702, $\rho_b$ represents density of the substrate 705, and $\rho_p$ represents density of each of the piezoelectric elements 706*a* and 706*b*.

Based on the above configuration, the ratio (EI/ρA) of bending stiffness (EI) to the mass per unit length (ρA) is calculated.

For example, as shown in the above specific example, in the case where a length (L) of the piezoelectric diaphragm 102 is 62 mm and the peripheral fixation condition for the piezoelectric diaphragm 102 is set at fixation of short sides and freedom of long sides, the piezoelectric diaphragm 102 is regarded as a both-ends-fixed beam having a length of 62 mm. Bending vibration frequency ($f_1$) of the both-ends-fixed beam satisfies Expression 4.

(Math. 2)

$$f_1 = \frac{1}{2\pi} \cdot \frac{4.73^2}{L^2} \cdot \sqrt{\frac{EI}{\rho A}} \quad \text{(Expression 4)}$$

In the case where the piezoelectric speaker 101 is composed like the piezoelectric speaker 701, in other words, the substrate 105 is uniform, the ratio (EI/ρA) of bending stiffness (EI) to the mass per unit length (ρA) in the piezoelectric diaphragm 102 is calculated by Expression 4.

For example, as shown in the above specific example, in the case where $f_1$ is 260 Hz and L is 62 mm, EI/ρA is about 0.079 ($N \cdot m^3/kg$). It is noted that in the case where the substrate 105 is uniform, the density ($\rho_b$) of the substrate 105 is 1,400 $kg/m^3$, and the Young's modulus ($E_b$) of the substrate 105 is 4.9 GPa, a thickness of the substrate 105 is calculated as 158 μm.

Next, size and property of each of the regions are determined (S103). Specifically, based on the calculated ratio (EI/ρA), a thickness and property of the substrate 105 are determined in each of the bass-range sound reproduction region 107 and the treble-range sound reproduction regions 108*a* and 108*b* so as to satisfy Expression 5.

(Math. 3)

$$\frac{E_L I_L}{\rho_L A_L} < \frac{EI}{\rho A} < \frac{E_H I_H}{\rho_H A_H} \quad \text{(Expression 5)}$$

Here, $E_L$ represents the Young's modulus of the bass-range sound reproduction region 107, and $I_L$ represents a cross-sectional secondary moment of the bass-range sound reproduction region 107. Here, $E_L I_L$ represents bending stiffness of the bass-range sound reproduction region 107, $\rho_L$ represents density of the bass-range sound reproduction region 107, $A_L$ represents a cross-sectional area of the bass-range sound reproduction region 107, and $\rho_L A_L$ represents a mass per unit length of the bass-range sound reproduction region 107.

Similarly, $E_H$ represents the Young's modulus of each of the treble-range sound reproduction regions 108*a* and 108*b*, $I_H$ represents a cross-sectional secondary moment of each of the treble-range sound reproduction regions 108*a* and 108*b*, $E_H I_H$ represents bending stiffness of each of the treble-range sound reproduction regions 108*a* and 108*b*, $\rho_H$ represents density of each of the treble-range sound reproduction regions 108*a* and 108*b*, $A_H$ represents a cross-sectional area of each of the treble-range sound reproduction regions 108*a* and 108*b*, and $\rho_H A_H$ represents a mass per unit length of each of the treble-range sound reproduction regions 108*a* and 108*b*.

Figure 13:
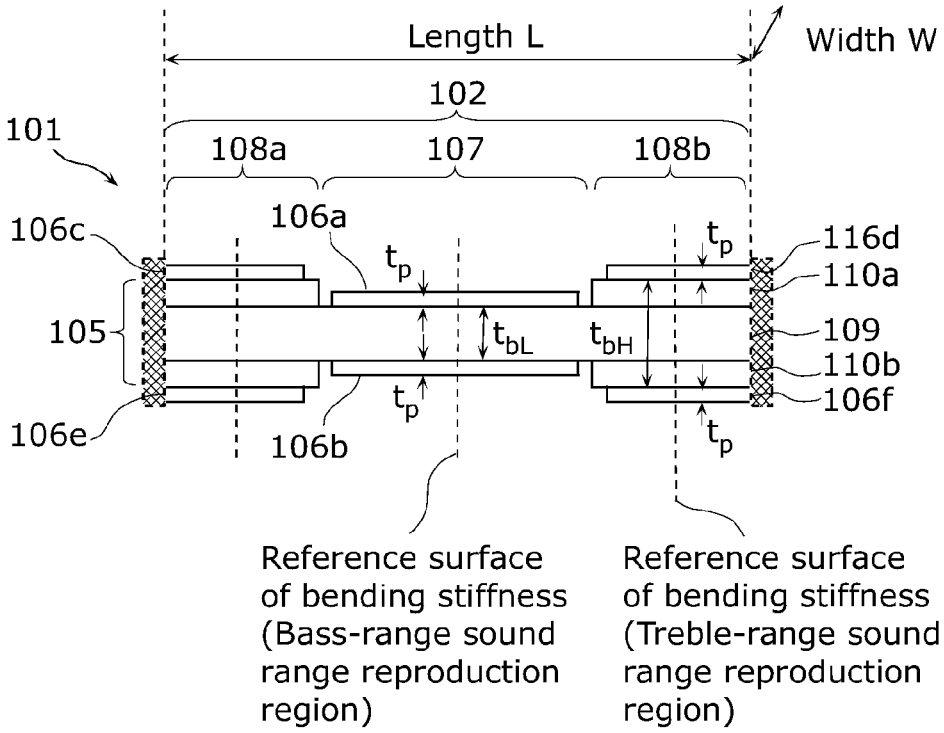
FIG. 13 is a diagram showing a second example of a piezoelectric speaker according to Embodiment 7.

FIG. 13 is a diagram schematically showing a piezoelectric speaker to be designed. The piezoelectric speaker 101 shown in FIG. 13 corresponds to the piezoelectric speaker 101 according to Embodiment 1. Similarly to an example of FIG. 12, a length of the piezoelectric diaphragm 102 is L and a width of the piezoelectric diaphragm 102 is W. Moreover, a thickness of the substrate 105 in the bass-range sound reproduction region 107 is $t_{bL}$. Moreover, a thickness of the substrate 105 in the treble-range sound reproduction regions 108*a* and 108*b* is $t_{bH}$. A thickness of each of the piezoelectric elements 106*a* to 106*f* is $t_p$.

In this case, a relational expression about bending stiffness ($E_L I_L$) of a reference surface of the bass-range sound reproduction region 107 can be obtained by replacing $t_b$ of Expression 2 with $t_{bL}$. And a relational expression about a mass per unit length ($\rho_L A_L$) of the bass-range sound reproduction region 107 can be obtained by replacing $t_b$ of Expression 3 with $t_{bL}$.

Similarly, a relational expression about bending stiffness ($E_H I_H$) of a reference surface of the treble-range sound reproduction regions 108*a* and 108*b* can be obtained by replacing $t_b$ of Expression 2 with $t_{bH}$. Meanwhile, a relational expression about a mass per unit length ($\rho_H A_H$) of the treble-range sound reproduction regions 108*a* and 108*b* can be obtained by replacing $t_b$ of Expression 3 with $t_{bH}$.

Based on the relational expressions obtained by the above replacements, the calculated ratio (EI/ρA), and Expression 5, a length and a thickness of each of the bass-range sound reproduction region 107 and the treble-range sound reproduction regions 108*a* and 108*b* are determined.

For example, based on the above specific example, a length of the bass-range sound reproduction region 107 is determined as 30 mm. A thickness of the substrate 105 of the bass-range sound reproduction region 107 is determined as 75 μm. A length of each of the treble-range sound reproduction regions 108*a* and 108*b* is determined as 15.5 mm. A thickness of the substrate 105 of the treble-range sound reproduction regions 108*a* and 108*b* is determined as 225 μm. These are optionally determined to satisfy Expression 5.

More preferably, a length of each of the treble-range sound reproduction regions 108*a* and 108*b* and a length of the bass-range sound reproduction region 107 are determined such that, as described above, the length of each of the treble-range sound reproduction regions 108*a* and 108*b* is shorter than the length of the bass-range sound reproduction region 107.

Moreover, the length and the thickness of each of the treble-range sound reproduction regions 108*a* and 108*b* and the bass-range sound reproduction region 107 may be determined such that a frequency of beam bending vibration in each of the treble-range sound reproduction regions 108*a* and 108*b* and the bass-range sound reproduction region 107 corresponds to a desired frequency. In this case, the length and the thickness are determined by a relational expression about the beam bending vibration frequency based on the peripheral fixation condition for the treble-range sound reproduction regions 108*a* and 108*b* and the bass-range sound reproduction region 107.

Based on the above-described designing method, configurations of the bass-range sound reproduction region 107 and the treble-range sound reproduction regions 108*a* and 108*b* of the piezoelectric speaker 101 are specifically determined. Then, a wider sound range reproduction capacity is secured compared with the case where the substrate 105 is uniform.

It is noted that a whole or part of the above described designing method is performed by a computer. A whole or part of the designing method may be realized as a program for causing a computer to execute steps. A program for causing a computer to execute steps may be recorded on a non-transitory computer readable medium such as Compact Disc Read-only memory (CD-ROM).

(Embodiment 8)

Embodiment 8 shows a piezoelectric speaker including characteristic components described in the above plural embodiments.

Figure 14:
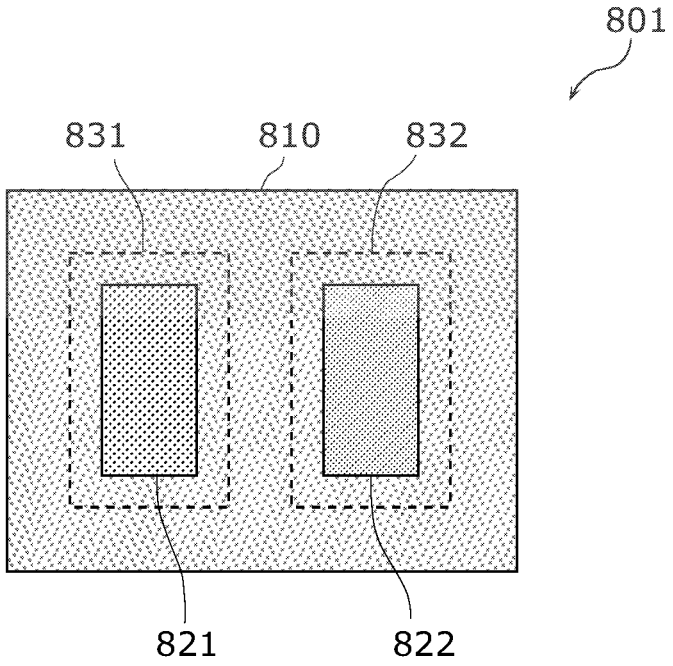
FIG. 14 is a diagram showing a piezoelectric speaker according to Embodiment 8.
Figure 15:
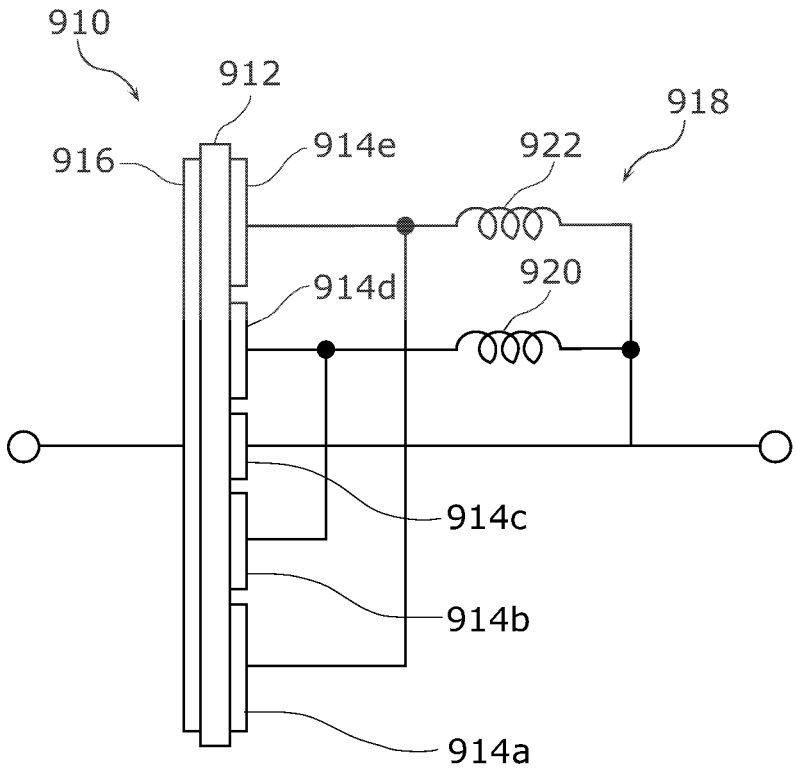
FIG. 15 is a diagram showing a piezoelectric speaker according to a conventional technique.

FIG. 14 is a diagram showing a piezoelectric speaker according to Embodiment 8. A piezoelectric speaker 801 shown in FIG. 14 radiates acoustic waves by vibrating according to an applied voltage.

A substrate 810 includes a first region 831 and a second region 832. The first region 831 has first bending stiffness against bending of a surface which is perpendicular to a vibration direction. The second region 832 has second bending stiffness against bending of a surface which is perpendicular to a vibration direction. The first bending stiffness and the second bending stiffness are different from each other.

On the first region 831, a first piezoelectric element 821 is mounted. A voltage of a first frequency band is applied to the first piezoelectric element 821. On the second region 832, a second piezoelectric element 822 is mounted. A voltage of a second frequency band is applied to the second piezoelectric element 822. The first frequency band and the second frequency band are different from each other.

This causes bending vibration in each of the two regions corresponding to the two bending stiffnesses which are different from each other. A difference between the two bending stiffnesses makes it difficult for bending stiffness occurring in one of the regions to be transmitted to the other region. Moreover, these two regions are included in one unit of the substrate 810. Therefore, the piezoelectric speaker 801 can reduce deterioration in sound quality even in a limited space and secure a capacity of reproducing sound in a wide range.

It is noted that in the structure, the second frequency band may be higher than the first frequency band and the second bending stiffness may be greater than the first bending stiffness. In this case, a fundamental resonance frequency is high in the second region 832 having the second bending stiffness that is relatively large, and a fundamental resonance frequency is low in the first region 831 having the first bending stiffness that is relatively small. Therefore, the two regions having different bending stiffnesses are appropriately used as a treble-range sound reproduction region and a bass-range sound reproduction region.

Moreover, in a surface in which the second frequency band is higher than the first frequency band and is perpendicular to a vibration direction, an area of the second region 832 may be smaller than an area of the first region 831. In this case, a fundamental resonance frequency is high in the second region 832 that is relatively small, and a fundamental resonance frequency is low in the first region 831 that is relatively large. Therefore, the two regions having different sizes are appropriately used as a treble-range sound reproduction region and a bass-range sound reproduction region.

Moreover, the piezoelectric speaker 801 may include the plural second piezoelectric elements, each of which is the second piezoelectric element 822. The substrate 810 may include the plural second regions, each of which is the second region 832. On the second regions, the plural second piezoelectric elements may be mounted. A voltage of the second frequency band higher than a first frequency band may be applied to each of the plural second piezoelectric elements. With this, size of treble-range sound reproduction regions can be secured as a whole even though each of the treble-range sound reproduction regions is small. Therefore, sound pressure in a treble-range sound is secured.

Moreover, it is preferable that a ratio of bending stiffness to a mass per unit length in the first region 831 and the first piezoelectric element 821 be smaller than a standard ratio. In addition, it is preferable that a ratio of bending stiffness to a mass per unit length in the second region 832 and the second piezoelectric element 822 be larger than the standard ratio. The standard ratio is specified according to a predetermined resonance frequency. With this, the two regions satisfying standards specified by the predetermined condition can be appropriately used as a treble-range sound reproduction region and a bass-range sound reproduction region.

Moreover, the piezoelectric speaker 801 may further include a circuit which applies a voltage of the first frequency band to the first piezoelectric element 821 and a voltage of the second frequency band to the second piezoelectric element 822. With this, an appropriate voltage can be applied to the first piezoelectric element 821 and the second piezoelectric element 822.

Moreover, the substrate 810 may be made of laminated plate materials. Furthermore, it is preferable that the substrate 810 be composed such that a thickness of the substrate 810 in the first region 831 is different from a thickness of the substrate 810 in the second region 832. For example, a variation in bending stiffness can be realized by lamination of plate materials having the same raw material.

Moreover, part of a circuit to apply a voltage may be placed between the laminated plate materials. This allows a circuit to be incorporated into the substrate 810. Therefore, the substrate 810 and the circuit are integrated, which are easily incorporated into an apparatus. Moreover, connection to a circuit at an edge of the substrate 810 becomes possible. Therefore, wiring becomes easier.

Moreover, it is preferable that each of the laminated plate materials be made of polyethylene terephthalate (PET), polycarbonate, or polyimide. Polyethylene terephthalate (PET) and polycarbonate are effective in applications requiring lightweight and low cost properties. Polyimide is effective in applications requiring properties of resistance to the environment such as under high temperature.

Moreover, the substrate 810 may include an edge region having elasticity between the first region 831 and the second region 832. This makes it difficult for bending vibration occurring in one of the regions to be transmitted to the other region. Therefore, the piezoelectric speaker 801 can reduce deterioration in sound quality.

Moreover, the substrate 810 may include an edge region having elasticity in at least part of the peripheral portion of the first region 831 or the second region 832. This makes it difficult for bending vibration occurring in a specific region to be transmitted to outside the region. Therefore, the piezoelectric speaker 801 can reduce deterioration in sound quality.

Moreover, it is preferable that the edge region be made of polyethersulfone (PES) or styrene butadiene rubber (SBR). A flexible plastic material such as polyethersulfone (PES) is effective in applications requiring heat resistant and water resistant properties. A rubber-based polymer material such as styrene butadiene rubber (SBR) has a high coefficient of material internal loss and can reduce peak of frequency characteristics caused by resonance. Therefore, such a rubber-based polymer material is effective in applications requiring flat output characteristics.

Moreover, at least part of the first region 831 and at least part of the second region 832 may be made of a uniformly formed plate material. With this, cost to join the first region 831 to the second region 832 can be reduced. Moreover, for example, it becomes possible for the piezoelectric speaker 801 to be manufactured at a low cost by lamination of plural plate materials.

Moreover, a piezoelectric speaker array may be composed of piezoelectric speakers, each of which is the piezoelectric speaker 801. With this, directivity of acoustic waves can be controlled with use of the plural piezoelectric speakers.

Moreover, in the case where each of the second regions is a treble-range sound reproduction region, it is preferable that plural piezoelectric speakers be arranged such that an interval between the second regions is shorter than an interval between the first regions. The control of directivity requires plural sound sources in especially in a treble-range sound to be placed at a narrower interval. Therefore, the performance of directivity control is improved by arranging plural treble-range sound regions at a narrow interval.

Moreover, it is preferable that the plural piezoelectric speakers be arranged at a predetermined interval. Moreover, it is preferable that the plural piezoelectric speakers be arranged on one of a straight line, a convex curved line, a concave curved line, a planar surface, a convex surface, and a concave surface. With this, turbulence of acoustic waves radiated from the piezoelectric speaker array can be reduced and the performance of directivity control can be improved. In other words, desired directivity can be obtained without using a complicated control.

It is preferable that the predetermined interval be a regular interval, but is not necessarily required to be the regular interval. The predetermined interval may be an interval determined according to predetermined rules. It is preferable that a convex curved line and a concave curved line be smooth like a circular arc, a conic section, or the like. It is preferable that a convex surface and a concave surface be a curved surface like a spherical surface, an elliptical surface, or the like. With this, acoustic waves can be radiated in a predetermined direction and effective directivity can be obtained.

Moreover, for example, the plural piezoelectric speakers may be arranged such that a row and a column are formed along two directions which are perpendicular to each other on a planar surface. With this, acoustic waves can be radiated from the piezoelectric speakers which are placed in order. Therefore, turbulence of acoustic waves can be reduced and desired directivity can be obtained.

Moreover, an audio-visual apparatus may be made of the above described piezoelectric speaker array and a display unit. In this case, the display unit displays an image included in audio-visual content. Then, the piezoelectric speaker array radiates, as acoustic waves, sound included in the audio-visual content. With this, images and sound included in the audio-visual content can be appropriately reproduced.

Moreover, a sound reproduction panel may be made of the piezoelectric speaker array and a package in which the piezoelectric speaker array is stored. With this, the piezoelectric speaker array can be incorporated into the sound reproduction panel and can be applied to various applications.

(Other Modifications)

In the embodiments, the bass-range sound reproduction region and the treble-range sound reproduction region are regarded to all have a neutral surface of vibration on the same planer surface and a surface radiating acoustic waves is regarded to be on the same planar surface. However, the present invention is not limited to the above embodiments, and, for example, the bass-range sound reproduction region may operate as a source of vibration. A diaphragm which operates as a surface of radiating acoustic waves may be located on a surface different from a neutral surface of a substrate.

Moreover, the configurations of the piezoelectric speakers according to the embodiments are all rectangular. However, another form may be adopted as long as an effect of controlling directivity and high quality sound reproduction may both be obtained. For example, a configuration of the piezoelectric speaker may be a round shape or an elliptical shape. Or, a configuration of the piezoelectric speaker may have other shapes than the rectangular shapes, such as a polygonal shape including triangle or hexagon. Likewise, any form of each of the regions is acceptable.

Moreover, in the embodiments, a piezoelectric element is illustrated as a rectangular shape. However, the piezoelectric element may have another shape.

Moreover, the number of piezoelectric speakers of a piezoelectric speaker array and the number of regions of a piezoelectric speaker are not limited to examples described in the embodiments and can be modified optionally.

Moreover, in the embodiments, piezoelectric speakers radiating acoustic waves into the air are shown. However, structures shown in the embodiments may be applied to a piezoelectric acoustic transducer which radiates acoustic waves into a medium other than the air. For example, the above described configurations may be applied to a piezoelectric acoustic transducer which radiates acoustic waves into liquid, such as an underwater speaker. Moreover, the above described configurations may be applied to a piezoelectric acoustic transducer which radiates acoustic waves into a solid.

As described above, the piezoelectric speaker and the piezoelectric speaker array according to the present invention have been described based on the embodiments, but the present invention is not intended to be limited to the embodiments. Modifications obtained from an optional combination of components described in the embodiments also fall within the scope of the present invention. For example, an edge as included in the piezoelectric speaker 301 and treble-range sound reproduction regions as included in the piezoelectric speaker 401 may be placed on a two-dimensional planar surface.

Furthermore, variations of the embodiments conceived by those skilled in the art fall within the scope of the present invention as long as they do not depart from the spirit and scope of the present invention.

Industrial Applicability

The present invention is applicable to various apparatuses which radiate acoustic waves, such as a speaker, a radio, an audio player, a sound reproduction panel, an audio-visual apparatus, a piezoelectric acoustic transducer, a mobile phone apparatus, and a television receiving set.

What is claimed is:

1. A piezoelectric speaker which radiates acoustic waves by vibrating according to an applied voltage, said piezoelectric speaker comprising:

a substrate which includes (i) a first region having first bending stiffness against bending of a plane perpendicular to a vibration direction and (ii) a second region having second bending stiffness against bending of the perpendicular plane, the second bending stiffness being different from the first bending stiffness;

a first piezoelectric element which is mounted on said first region and to which a voltage of a first frequency band is applied; and a second piezoelectric element which is mounted on said second region and to which a voltage of a second frequency band different from the first frequency band is applied, wherein said substrate is made of a plurality of laminated plate materials, and a thickness of said substrate in said first region is different from a thickness of said substrate in said second region.

2. The piezoelectric speaker according to claim 1, wherein said substrate includes said second region having the second bending stiffness against bending of the perpendicular plane, the second bending stiffness being greater than the first bending stiffness, and the voltage of the second frequency band is applied to said second piezoelectric element, the voltage of the second frequency band being higher than the voltage of the first frequency band.

3. The piezoelectric speaker according to claim 2, wherein said substrate includes said first region and said second region, and an area of said second region in the perpendicular plane is smaller than an area of said first region in the perpendicular plane.

4. The piezoelectric speaker according to claim 3, comprising a plurality of second piezoelectric elements, each of which is said second piezoelectric element, wherein said substrate includes a plurality of second regions, each of which is said second region and having one of said piezoelectric elements mounted thereon, and the voltage of the second frequency band is applied to each of said second piezoelectric elements.

5. The piezoelectric speaker according to claim 2, wherein said substrate, said first piezoelectric element, and said second piezoelectric element are composed such that a ratio of bending stiffness to a mass per unit length in said first region and said first piezoelectric element is smaller and a ratio of bending stiffness to a mass per unit length in said second region and said second piezoelectric element is larger than a standard ratio specified by a predetermined resonance frequency.

6. The piezoelectric speaker according to claim 1, further comprising a circuit which applies the voltage of the first frequency band to said first piezoelectric element and the voltage of the second frequency band to said second piezoelectric element.

7. The piezoelectric speaker according to claim 1, further comprising a circuit which applies the voltage of the first frequency band to said first piezoelectric element and the voltage of the second frequency band to said second piezoelectric element, wherein part of said circuit is placed between said laminated plate materials.

8. The piezoelectric speaker according to claim 1, wherein each of said laminated plate materials is made of polyethylene terephthalate, polycarbonate, or polyimide.

9. The piezoelectric speaker according to claim 1, wherein said substrate includes an edge region having elasticity between said first region and said second region.

10. The piezoelectric speaker according to claim 1, wherein said substrate includes an edge region having elasticity at least in part of a peripheral portion of said first region or said second region.

11. The piezoelectric speaker according to claim 9, wherein said edge region is made of polyethersulfone or styrene butadiene rubber.

12. A piezoelectric speaker array comprising a plurality of piezoelectric speakers, each of which is the piezoelectric speaker according to claim 1.

13. A piezoelectric speaker array comprising a plurality of piezoelectric speakers, each of which is the piezoelectric speaker according to claim 4, wherein said piezoelectric speakers are arranged such that an interval between said second regions of said piezoelectric speakers is shorter than an interval between said first regions of said piezoelectric speakers.

14. A piezoelectric speaker array according to claim 12, wherein said piezoelectric speakers are arranged at a predetermined interval.

15. The piezoelectric speaker array according to claim 12, wherein said piezoelectric speakers are arranged on one of a straight line, a convex curved line, a concave curved line, a planar surface, a convex surface, and a concave surface.

16. A piezoelectric speaker array according to claim 15, wherein said piezoelectric speakers are arranged to form rows and columns along two axes which are perpendicular to each other on said planar surface.

17. An audio-visual apparatus comprising:

the piezoelectric speaker array according to claim 12; and a display unit configured to display video included in audio-visual content, wherein said piezoelectric speaker array radiates sound as the acoustic waves included in the audio-visual content.

18. A sound reproduction panel comprising:

the piezoelectric speaker array according to claim 12; and a package in which said piezoelectric speaker array is stored.

19. A piezoelectric acoustic transducer which radiates acoustic waves by vibrating according to an applied voltage, said piezoelectric acoustic transducer comprising:

a substrate which includes (i) a first region having first bending stiffness against bending of a plane perpendicular to a vibration direction and (ii) a second region having second bending stiffness against bending of the perpendicular plane, the second bending stiffness being different from the first bending stiffness;

a first piezoelectric element which is mounted on said first region and to which a voltage of a first frequency band is applied; and a second piezoelectric element which is mounted on said second region and to which a voltage of a second frequency band different from the first frequency band is applied, wherein said substrate is made of a plurality of laminated plate materials, and a thickness of said substrate in said first region is different from a thickness of said substrate in said second region.

20. A piezoelectric speaker which radiates acoustic waves by vibrating according to an applied voltage, said piezoelectric speaker comprising:

a substrate which includes (i) a first region having first bending stiffness against bending of a plane perpendicular to a vibration direction and (ii) a second region having second bending stiffness against bending of the perpendicular plane, the second bending stiffness being different from the first bending stiffness;

a first piezoelectric element which is mounted on said first region and to which a voltage of a first frequency band is applied; and a second piezoelectric element which is mounted on said second region and to which a voltage of a second frequency band different from the first frequency band is applied, wherein said substrate includes said second region having the second bending stiffness against bending of the perpendicular plane, the second bending stiffness being greater than the first bending stiffness, the voltage of the second frequency band is applied to said second piezoelectric element, the voltage of the second frequency band being higher than the voltage of the first frequency band, said substrate includes said first region and said second region, and an area of said second region in the perpendicular plane is smaller than an area of said first region in the perpendicular plane, the piezoelectric speaker includes a plurality of second piezoelectric elements, each of which is said second piezoelectric element, said substrate includes a plurality of second regions, each of which is said second region and having one of said piezoelectric elements mounted thereon, and the voltage of the second frequency band is applied to each of said second piezoelectric elements.

21. A piezoelectric speaker which radiates acoustic waves by vibrating according to an applied voltage, said piezoelectric speaker comprising:

a substrate which includes (i) a first region having first bending stiffness against bending of a plane perpendicular to a vibration direction and (ii) a second region having second bending stiffness against bending of the perpendicular plane, the second bending stiffness being different from the first bending stiffness;

a first piezoelectric element which is mounted on said first region and to which a voltage of a first frequency band is applied; and a second piezoelectric element which is mounted on said second region and to which a voltage of a second frequency band different from the first frequency band is applied, wherein said substrate includes said second region having the second bending stiffness against bending of the perpendicular plane, the second bending stiffness being greater than the first bending stiffness, the voltage of the second frequency band is applied to said second piezoelectric element, the voltage of the second frequency band being higher than the voltage of the first frequency band, and said substrate, said first piezoelectric element, and said second piezoelectric element are composed such that a ratio of bending stiffness to a mass per unit length in said first region and said first piezoelectric element is smaller and a ratio of bending stiffness to a mass per unit length in said second region and said second piezoelectric element is larger than a standard ratio specified by a predetermined resonance frequency.

22. A piezoelectric speaker which radiates acoustic waves by vibrating according to an applied voltage, said piezoelectric speaker comprising:

a substrate which includes (i) a first region having first bending stiffness against bending of a plane perpendicular to a vibration direction and (ii) a second region having second bending stiffness against bending of the perpendicular plane, the second bending stiffness being different from the first bending stiffness;

a first piezoelectric element which is mounted on said first region and to which a voltage of a first frequency band is applied; and a second piezoelectric element which is mounted on said second region and to which a voltage of a second frequency band different from the first frequency band is applied, wherein said substrate includes an edge region having elasticity between said first region and said second region, and said edge region is made of polyethersulfone or styrene butadiene rubber.

* * * * *